US010315103B2

(12) United States Patent
Groller et al.

(10) Patent No.: US 10,315,103 B2
(45) Date of Patent: Jun. 11, 2019

(54) MODULAR GAME CASE

(71) Applicants: Robert Groller, Manassas Park, VA (US); Roy Graham, Centreville, VA (US)

(72) Inventors: Robert Groller, Manassas Park, VA (US); Roy Graham, Centreville, VA (US)

( * ) Notice: Subject to any disclaimer, the term of this patent is extended or adjusted under 35 U.S.C. 154(b) by 347 days.

(21) Appl. No.: 13/874,419

(22) Filed: Apr. 30, 2013

(65) Prior Publication Data

US 2013/0307214 A1 Nov. 21, 2013

Related U.S. Application Data

(60) Provisional application No. 61/640,591, filed on Apr. 30, 2012.

(51) Int. Cl.
*A63F 11/00* (2006.01)
*A63F 3/00* (2006.01)

(52) U.S. Cl.
CPC ..... *A63F 11/00* (2013.01); *A63F 3/00895* (2013.01); *A63F 2003/00965* (2013.01)

(58) Field of Classification Search
CPC ..... A63F 11/00
USPC ..... 273/148
See application file for complete search history.

(56) References Cited

U.S. PATENT DOCUMENTS 2,695,112 A * 11/1954 Bonnevay ..... 217/7
3,352,390 A * 11/1967 Zalkind et al. ..... 190/100
3,710,900 A * 1/1973 Fink ..... 206/387.15
3,724,920 A * 4/1973 Beck ..... 312/184
3,880,429 A * 4/1975 Blumenaus ..... A63F 3/0023 273/282.2
D249,590 S * 9/1978 Berkman ..... D6/631
4,135,624 A * 1/1979 Rardin et al. ..... 206/425
D256,522 S 8/1980 Peterson
4,231,473 A 11/1980 Aprahamian
D266,208 S 9/1982 Cannon
4,505,388 A * 3/1985 Solomon ..... 206/425
4,781,384 A * 11/1988 Bois ..... 273/285
4,782,949 A 11/1988 Berkman
D304,461 S 11/1989 Foran
D305,705 S 1/1990 Stewart
D306,096 S * 2/1990 Dickinson et al. ..... D3/281
4,936,454 A * 6/1990 Wang ..... 206/425
(Continued)

*Primary Examiner* — John E Simms, Jr.
*Assistant Examiner* — Dolores R Collins
(74) *Attorney, Agent, or Firm* — Symbus Law Group, LLC; Clifford D. Hyra

(57) ABSTRACT

A new game piece chamber has a front surface, a rear surface, and an interior. Spaced apart railings extend in parallel from the front surface to the rear surface and have smooth surfaces facing the interior. A securing mechanism is attached to the railings opposite the smooth surfaces. One or more dividers are configured to be removably secured to the securing mechanism and to organize game pieces stored in the interior. A new game board chamber has a first side and a second, opposing side and a securing mechanism on at least one of the two sides. One or more game piece holders are configured for removable attachment to, and repositioning on, the securing mechanism. A game board organizer is attached to the first side or the second side. A new modular gaming case is configured to house game piece chambers and game board chambers.

31 Claims, 25 Drawing Sheets

(56) References Cited

U.S. PATENT DOCUMENTS

| | | | | | |
|---|---|---|---|---|---|
| D315,445 | S | * | 3/1991 | Lanius | D3/281 |
| 5,088,801 | A | * | 2/1992 | Rorke et al. | 312/184 |
| D326,559 | S | | 6/1992 | Szablak | |
| D326,777 | S | | 6/1992 | Newby, Sr. | |
| D327,292 | S | * | 6/1992 | Klodt | D19/75 |
| 5,193,706 | A | * | 3/1993 | Hanna et al. | 220/324 |
| 5,238,112 | A | | 8/1993 | Bell | |
| 5,253,756 | A | * | 10/1993 | Goekler | 206/307.1 |
| 5,295,742 | A | | 3/1994 | Knutson | |
| 5,366,069 | A | | 11/1994 | Seidner | |
| 5,370,460 | A | * | 12/1994 | Nelson | 383/4 |
| 5,390,787 | A | * | 2/1995 | Macasaet | 206/309 |
| 5,433,362 | A | * | 7/1995 | Battaglia | 224/312 |
| 5,475,204 | A | * | 12/1995 | Giamati et al. | 219/548 |
| 5,503,435 | A | * | 4/1996 | Kline | B42F 21/025 283/36 |
| D389,309 | S | * | 1/1998 | Shaw | D3/294 |
| D402,106 | S | | 12/1998 | Buckingham | |
| D404,916 | S | * | 2/1999 | Dickinson et al. | D3/281 |
| 5,992,623 | A | * | 11/1999 | Myers, Jr. | 206/315.9 |
| 6,164,442 | A | * | 12/2000 | Stravitz | 206/233 |
| D439,740 | S | * | 4/2001 | Harris | D3/276 |
| D459,073 | S | * | 6/2002 | Lee | D3/276 |
| 6,471,060 | B1 | | 10/2002 | Leyshon | |
| 6,789,692 | B2 | * | 9/2004 | Prezelin | 220/324 |
| 6,997,310 | B1 | * | 2/2006 | Fenley | 206/214 |
| 7,004,323 | B1 | * | 2/2006 | Symonds | 206/542 |
| D520,746 | S | | 5/2006 | Meyer | |
| 7,661,716 | B2 | * | 2/2010 | Hester et al. | 281/22 |
| 8,371,856 | B2 | * | 2/2013 | Shen et al. | 434/128 |
| 2007/0131572 | A1 | * | 6/2007 | Killinger | A45C 13/02 206/425 |
| 2007/0227926 | A1 | * | 10/2007 | Shapiro | 206/425 |
| 2010/0066017 | A1 | * | 3/2010 | Gowri | A63F 3/00 273/239 |
| 2013/0277262 | A1 | * | 10/2013 | Nemard | 206/438 |

* cited by examiner

MODULAR GAME CASE

This application claims the benefit of U.S. Provisional Application No. 61/640,591, filed Apr. 30, 2012, which is hereby incorporated by reference in its entirety.

FIELD

This disclosure describes herein a customizable game case. More specifically, this disclosure describes a modular game case for organizing, storing and transporting multiple games.

BACKGROUND

There are various kinds of storage and carrying cases for hardware, jewelry, crafts, specific games, etc. For example, a utility box can be utilized or configured to carry and store tools. Generally, utility boxes or storage containers contain rigid or fixed dividers for objects to be placed or stored within the containers. Current containers for board games or card games are designed to hold pieces, cards or a board for a specific and/or single game.

Needs exist for improved gaming cases.

SUMMARY

Example embodiments described herein relate to a customizable game case that may include a game board chamber, game piece chamber, and game piece compartments.

The customizable game case may be configured to hold game pieces or game objects of a plurality of games, and may be configured to close to prevent, limit or reduce the likelihood that parts of games are accidentally removed from the game case. More specifically, example embodiments provide a modular games case for organizing, storing and transporting multiple board, card and other types of games. The modular game case may have a plurality of customizable chambers, each with slots for removable labels. Furthermore, the customizable chambers may include sub-compartments to store game components in an organized manner.

Example embodiments described herein relate to a modular gaming case. The modular gaming case may include a game board chamber configured to house at least one game board and a game piece chamber. The game piece chamber may include railings with a plurality of ridges extending in parallel from a first surface of the game piece chamber to a second surface of the game piece chamber, a plurality of removable dividers and removable game piece compartments configured to be disposed along the ridges, and a side protrusion extending outward from the first surface.

In an embodiment, the plurality of removable dividers and the removable game piece compartments include notches.

In an embodiment, the removable dividers and removable game piece compartments may be placed in different configurations within the game piece chamber to change a size of partitions within the game piece chamber.

In an embodiment, wherein the size of at least one of the partitions is based on at least one gaming object.

In an embodiment, each of the removable game piece compartments include sub-chambers and removable sliding covers configured to cover a corresponding sub-chamber.

In an embodiment, the game board chamber, game piece chamber, removable dividers, and removable game piece compartments include a label.

In an embodiment, a game board within the game board chamber may be accessed while the game board chamber is disposed within the modular gaming case.

In an embodiment, if one of the game piece chambers is within the modular gaming case, the second surface of the game piece chamber is adjacent to a bottom surface of the modular gaming case.

A new modular gaming case includes an outer housing, a game board chamber configured to house at least one game board and to fit within the outer housing, and a game piece chamber configured to fit within the outer housing having railings with a plurality of ridges extending in parallel from a first surface of the game piece chamber to a second surface of the game piece chamber, a removable divider and a removable game piece compartment configured to be disposed along the ridges, and a side protrusion extending outward from the first surface. The removable divider and the removable game piece compartment may include notches. The removable divider and removable game piece compartment may be placed in different configurations within the game piece chamber to change a size of partitions within the game piece chamber. The size of at least one of the partitions may be based on at least one gaming object. The removable game piece compartment may include sub-chambers and removable sliding covers configured to cover a corresponding sub-chamber. The game board chamber, game piece chamber, removable divider, and removable game piece compartment may each include a label. A game board within the game board chamber may be accessed while the game board chamber is disposed within the modular gaming case. The second surface of the game piece chamber may be adjacent to a bottom of the outer housing when the game piece chamber is within the modular gaming case.

BRIEF DESCRIPTION OF THE DRAWINGS

The features and advantages of example embodiments will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
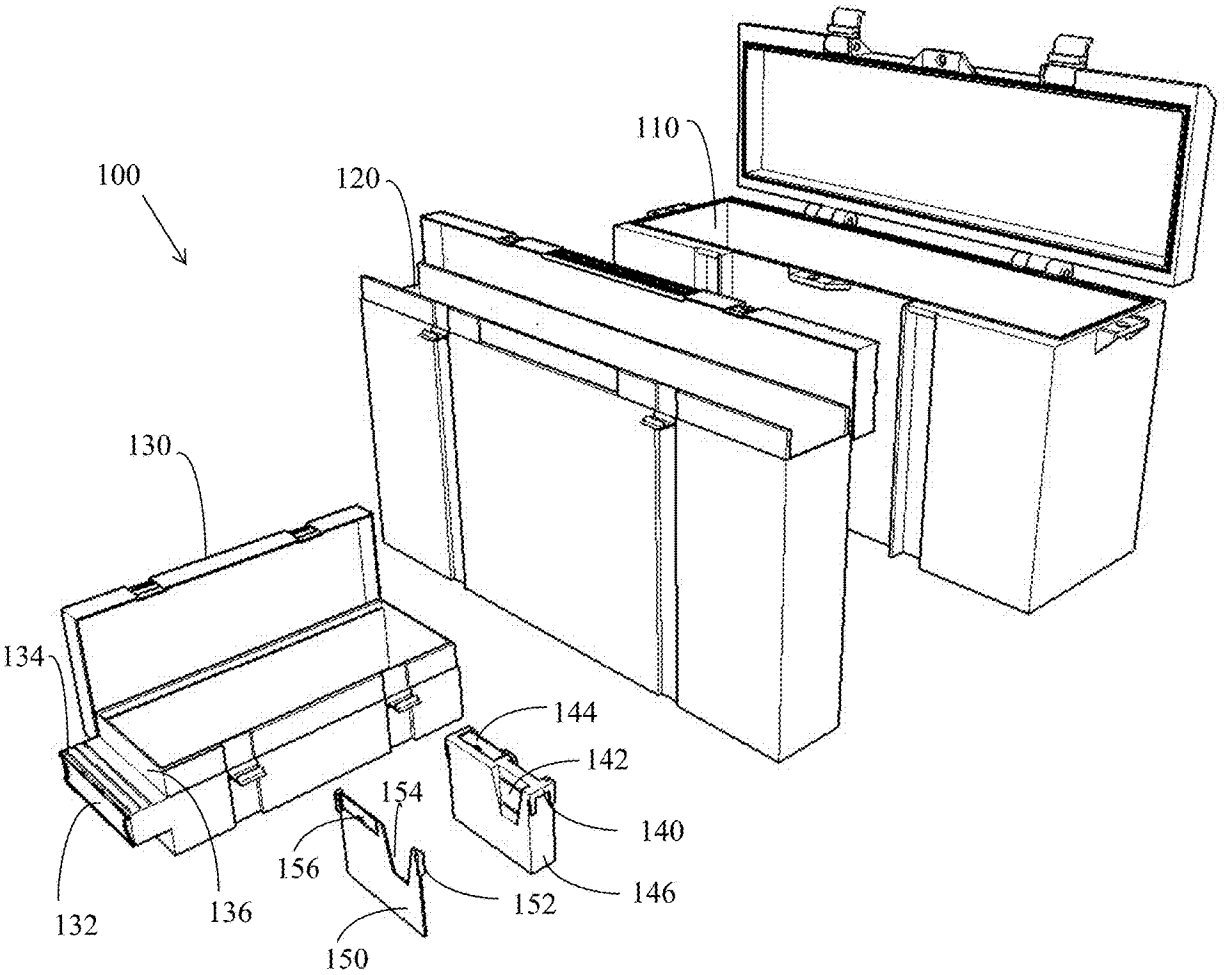
FIG. 1 depicts an embodiment of a modular game case with a game board chamber, game piece chamber, divider, and game piece compartment.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Example embodiments herein disclose a gaming case with a modular design to store, house and/or transport gaming components of various card, board, and other types of games simultaneously. The gaming case may include game piece chambers and game board chambers that are configured to be removed from the game case. Accordingly, objects within the game piece chambers and the game board chambers may be easily accessed.

Further, the game piece chambers may include smaller, removable game piece compartments to store and organize game objects, to allow for easy access and cleanup of the game objects. Also, each of the game board chambers, game piece chambers, dividers and game piece compartments may include a slot for a removable label to easily identify stored objects and what objects are to be placed within a compartment, chamber and/or partition.

The game piece chamber may include railings with a plurality of ridges configured to provide flexibility to hold a variety of different gaming objects. More specifically, smaller game piece compartments and dividers may be placed within the ridges to optimize storage space within a game piece chamber for objects placed therein and to customize the size of partitions within the game piece chamber. At a later time, the game piece compartments and dividers may be re-positioned over the railings and between ridges to vary the sizes of the partitions, and allow for game pieces of different types/sizes to be secured within the game piece chamber.

FIG. 1 depicts a game storage system 100 that may be configured to organize, store and transport a plurality of board and/or card games. The game storage system 100 may include removable and customizable chambers, each of the chambers may include a slot for removable labels, and the chambers may be divided or partitioned based on the size and/or parts of the games that are to be stored therein.

Game storage system 100 may include a modular game case 110. Modular game case 110 may include a plurality of modules that may be individually removed and inserted within modular game case 110. The modules may include board chamber 120 and game piece chamber 130. Game piece chamber 130 may include a game piece compartment 140 and a game piece divider 150 that may be individually removed, inserted and/or arranged within game piece chamber 130.

In an embodiment, modular game case 110 may be configured to house, hold or store up to ten game piece chambers 130, or up to two game board chambers 120, or a game board chamber 120 and up to five game piece chambers 130. Based on which game a user desires to play, the user may individually access a board within board game chamber 120 and/or game pieces within game piece chamber 130.

Game board chamber 120 may be configured to be disposed within modular game case 110. Game board chamber 120 may be configured to house, store or hold at least one game board. However, a plurality of game boards of various sizes may be housed or stored within game board chamber 120. If a user desires to access a game board within game board chamber 120, game board chamber 120 may be configured to be opened, and a game board within game board chamber 120 may be accessed while game board chamber 120 is inserted or disposed within modular game case 110. Also, game board chamber 120 may be removed from the modular gaming case, and a game board within game board chamber 120 may be subsequently accessed. Game board chamber 120 may include a slot (not shown) configured to hold a removable label. The removable label may be used to identify objects, such as a game board, stored within game board chamber 120.

An insert in the game board chamber may be made of, for example, thin, lightweight but sturdy cardboard, plastic, or fabric, and may hold about a half dozen game boards and manuals in individual partitions. For example, the insert may be sized to fit the game board case and include a bottom side and vertical dividers to partition the game board case. The partition may be removable and each partition may have a separate label. Indentations/cut-outs in the vertical partition walls may be used, similar to those featured in other components of the modular game case, to ease removal of boards from the game board chamber without removing all game boards.

Game piece chamber 130 may be configured to be inserted and removed from modular game case 110. Game piece chamber 130 may be configured to house, hold or store various game objects such as cards and/or dice, and game pieces for at least one game. Furthermore, the game objects and pieces may or may not correspond to a game board stored within game board chamber 120.

Game piece chamber 130 may also include a side protrusion 134. Side protrusion 134 may be disposed or positioned on a horizontal side 136 of game piece chamber 130. Side protrusion 134 may be a projection with notches, scores, or grooves for gripping so that a user may more easily move, hold or transport game piece chamber 130. Accordingly, side protrusion 134 may be configured such that game piece chamber 130 may be more easily be removed or inserted within modular game case 110, particularly when multiple game piece chambers are side by side in the modular game case 110. Game piece chamber 130 may also include a slot 132 positioned on a side of side protrusion 134 configured to hold a removable label. The removable label may be used to identify objects, such as the pieces of games, stored within game piece chamber 130.

Figure 7:
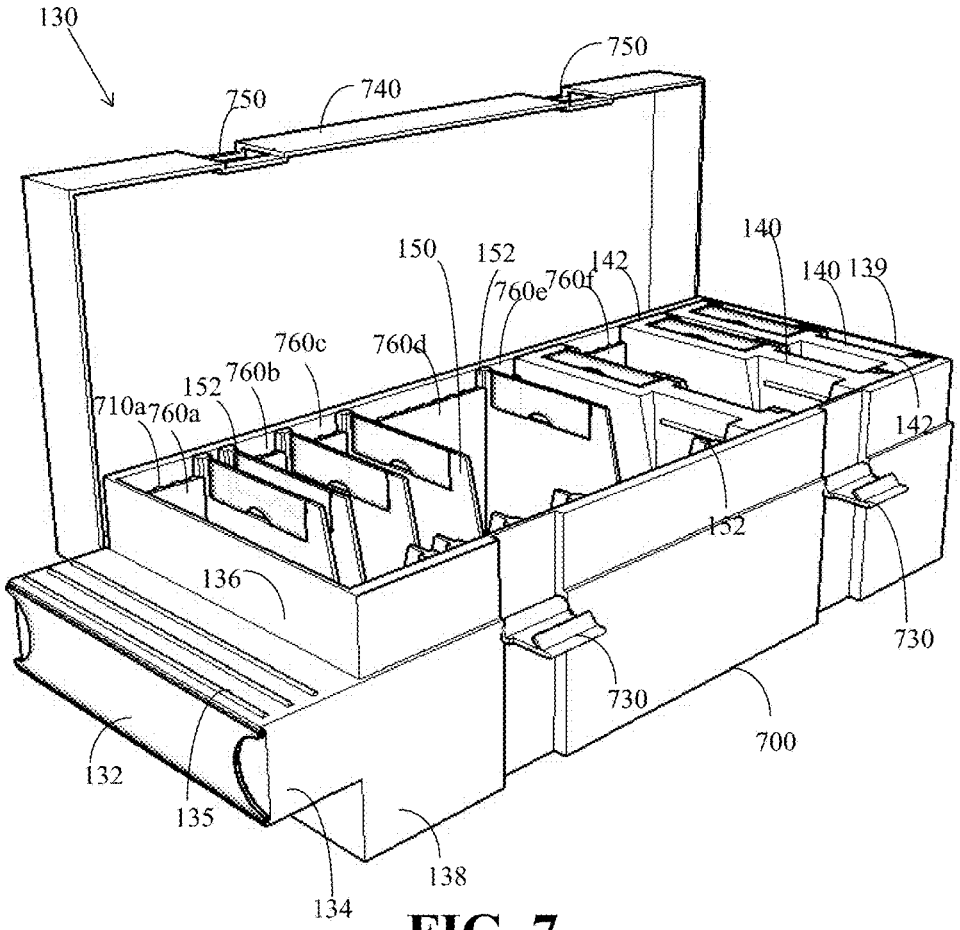
FIG. 7 depicts an embodiment of a game piece chamber with dividers and game piece compartments.

As shown in FIG. 7, Game piece chamber 130 may also include a system of ridges along railings for mounting or securing dividers 150 and/or at least one game piece compartment 140. Dividers 150 and/or game piece compartment 140 may form partitions of various sizes within game piece chamber 130 when positioned along or between the ridges and over the railings, and game piece objects may be placed within the partitions. Further, dividers 150 may be removed from game piece chambers and/or placed in varying configurations within game piece chamber 130. As such, the partitions within game piece chamber 130 may be changed, and accordingly have different sizes at different times.

Figure 8:
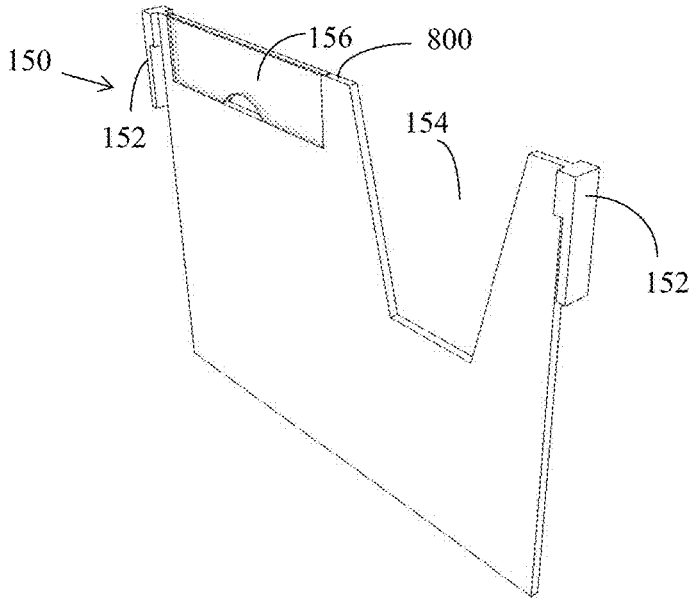
FIG. 8 depicts an embodiment of a divider.

As shown in FIG. 8, dividers 150 may include side projections 152 that are configured to seat between or be disposed over the railings and along or between the ridges within game piece chamber 130. As such, dividers 150 may be secured within game piece chamber 130 to form the partitions. Each of the dividers 150 may include a notch or space 154. Notch 154 may be configured for easier retrieval of cards, game pieces, or other objects stored within the partitions, even if tightly packed, without removal of dividers. Each of the dividers 150 may also include a slot 156 configured to hold a removable label. The slot 156 may be configured in any number of ways, for example it may have a hinged cover that lifts up for insertion of a label, or a label may be slid in from a top or side opening. The same is true for all label slots on all parts described herein.

Figure 9:
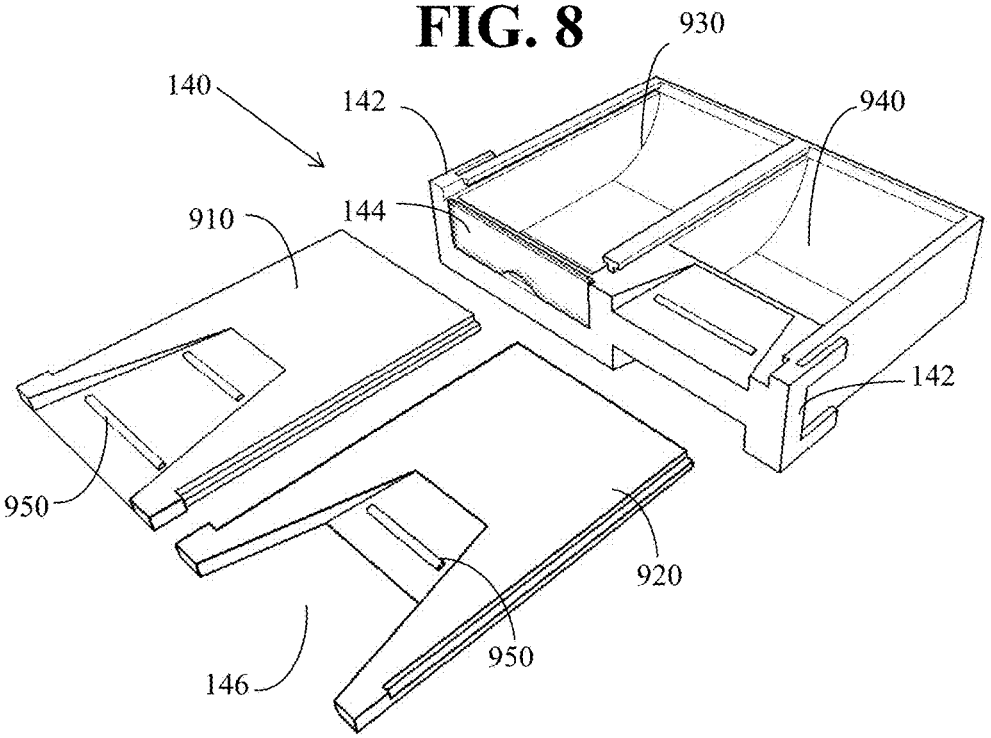
FIGS. 9 and 10 depict an embodiment of a game piece compartment.

Game piece compartment 140 may be configured to house game pieces and game objects, and may be inserted and removed from game piece chamber 130. Game piece compartment 140 may include side projections 142 that are configured to seat between or be disposed along or between the ridges and over the railings within the game piece chamber 130. As such, game piece compartment 140 may be secured within game chamber 130. Each game piece compartment 140 may have sliding covers configured (as shown in FIG. 9) to slide over sub-chambers within game piece compartment 140 to secure gaming objects within game piece compartment 140. The sliding covers may also be configured to slide off the sub-chambers so that a user may place gaming objects within game piece compartment 140. The sub-chambers may be curved at one or both ends to ease retrieval of small game pieces (which might otherwise get stuck in a corner). Further, each game piece compartment 140 may include a slot 144 configured to hold a removable label. Game piece compartment 140 may include notch or space 146. Notch 146 may be positioned such that if there are game objects between game piece compartment 140 and a divider 150, the game objects may be easily retrieved and grasped, while divider 150 and game piece compartment 140 are disposed between ridges.

Figure 2:
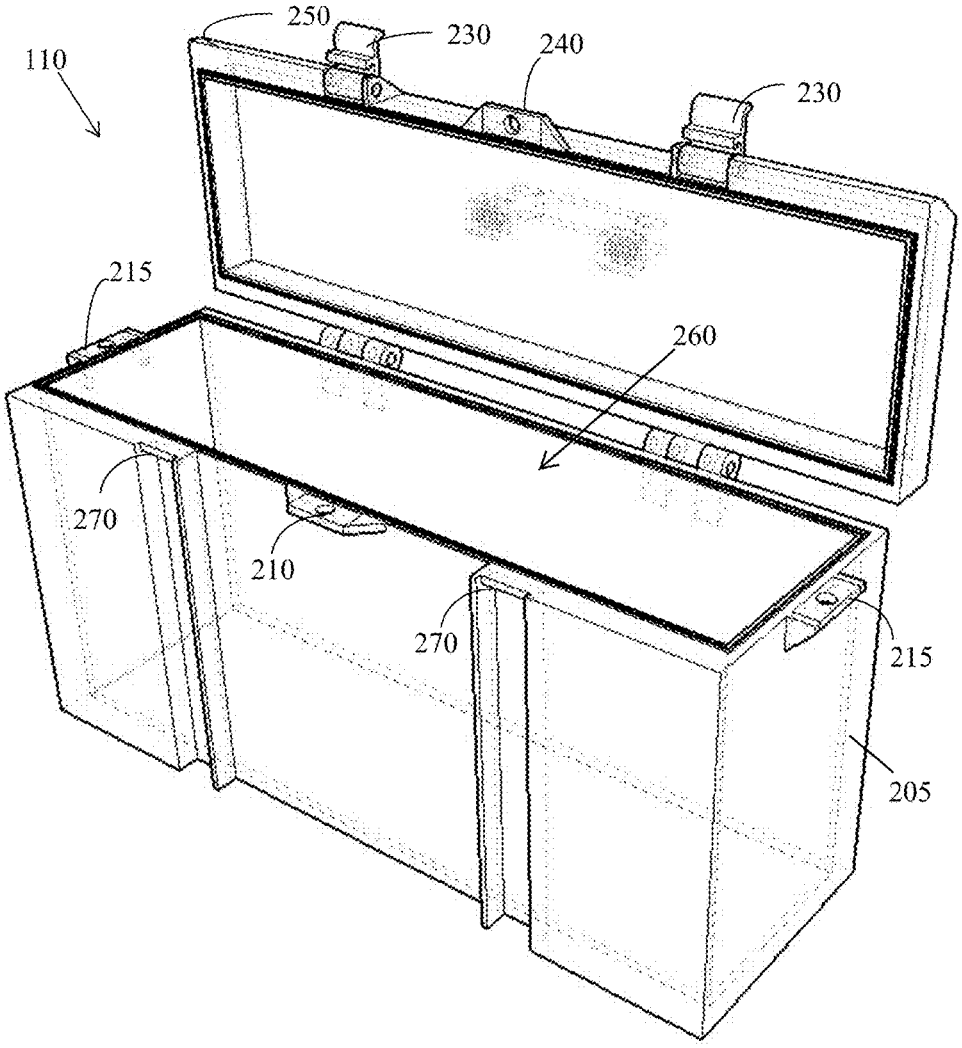
FIG. 2 depicts an embodiment of a modular game case in an open position.

FIG. 2 depicts an embodiment of modular game case 110 in an open position. Top case portion 250 of modular game case 110 may include latches 230 and top lock portions 240. Bottom case portion 205 may include an orifice 260, latch receiving mechanism 270, and bottom lock portions 210. Modular game case 100 serves as the outermost shell for game storage system 100, containing and protecting the other components and allowing for easy transportation, but in various embodiments may vary substantially in structure and appearance. The game case 100 is shown here constructed of a rigid material, such as rigid plastic. A rigid material will protect components stored inside the game case 100 during transport and storage, unless exposed to forces sufficient to break the game case. However, in other embodiments the modular game case may be constructed using a fabric or other soft materials. In such embodiments, the game case may be more comfortable and less cumbersome to carry and easier to stow in a vehicle or store in a tight space. Padding may be employed to reduce the risk of damage to interior components.

Figure 3:
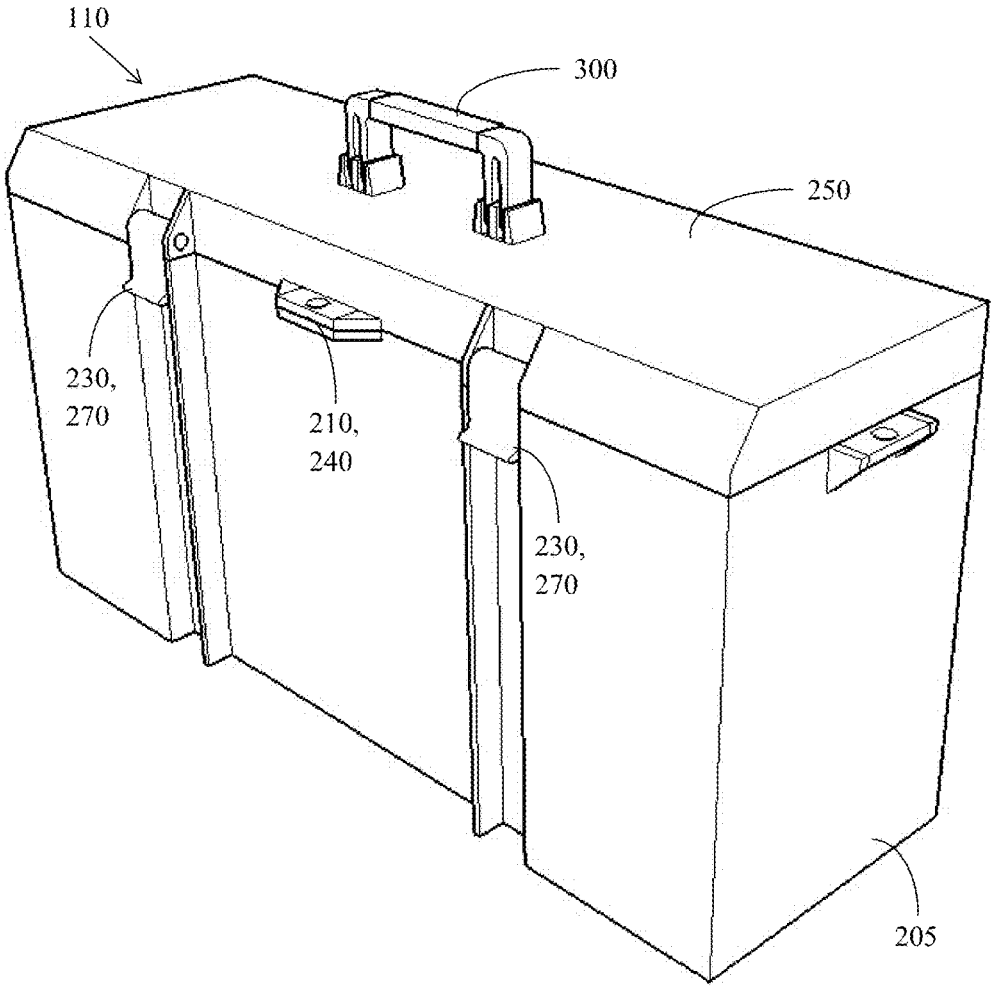
FIG. 3 depicts an embodiment of a modular game case in a closed position.

As shown in FIG. 3, if modular game case 110 is in a closed position, top case portion 250 may be adjacent to bottom case portion 205 and latches 230 may be locked or received by corresponding latch receiving mechanisms 270 to secure objects placed within orifice 260. Furthermore, top lock portion 240 may be positioned adjacent to a corresponding bottom lock portion 210, such that a lock may be positioned through a corresponding top lock portion 240 and a bottom lock portion 210. More so, the modular game case 110 may include a handle 300 for easier transport of the modular game case. Attachment points 215 may be secured to the ends of a shoulder strap for easy carrying of a modular game case loaded with heavy game boards, pieces, etc.

Figure 4:
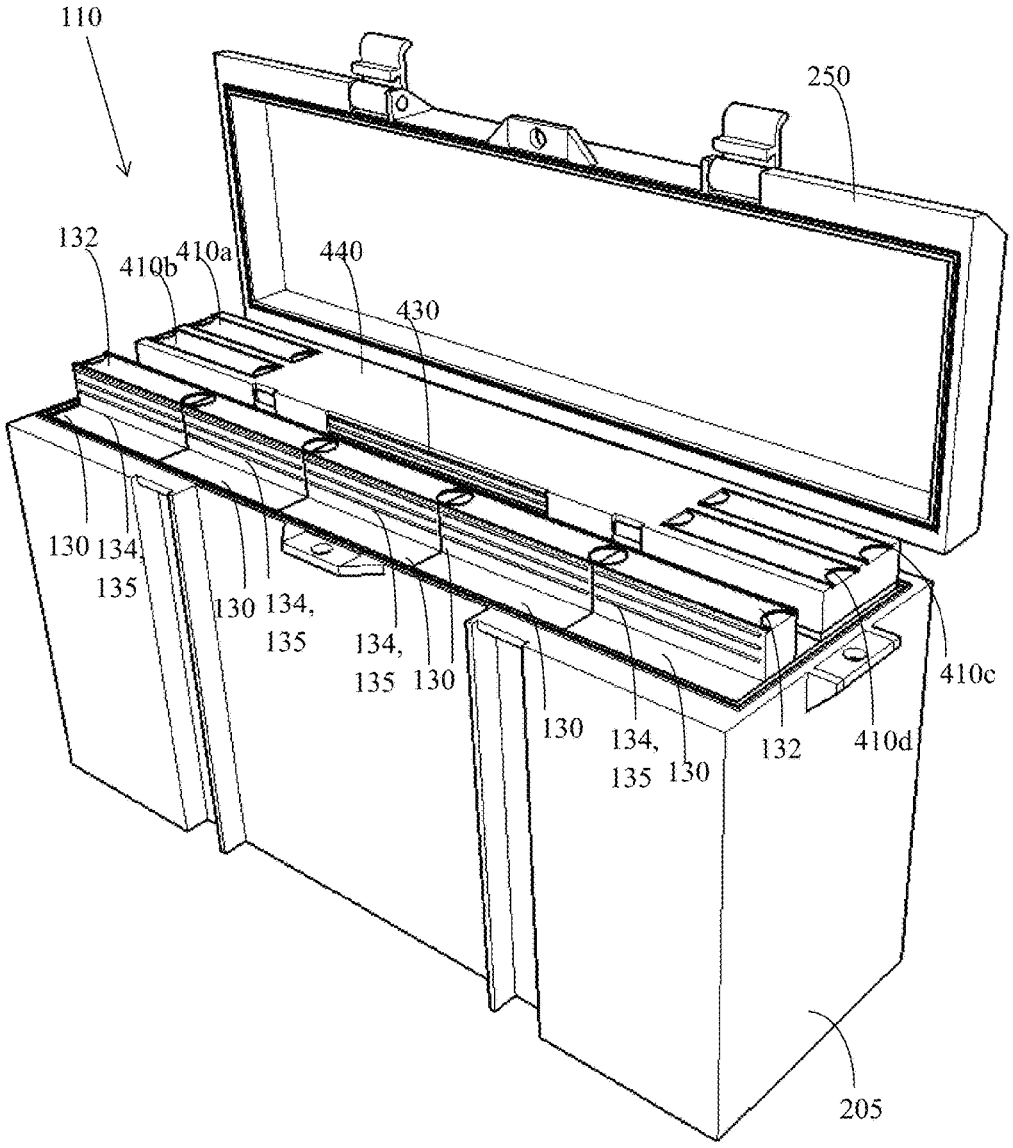
FIG. 4 depicts an embodiment of a game board chamber and game piece chambers disposed within the modular game case.

FIG. 4 depicts an embodiment of modular game case 110 in an open position housing game board chamber 120, and five game piece chambers 130.

Game board chamber 120 may be configured to hold at least one game board for a board game. However, a plurality of game boards of varying sizes for a plurality of board games may be stored within game board chamber 120. Game board chamber 120 may be disposed or placed in a lengthwise fashion within modular game case 110 such that game board chamber 120 is adjacent to each game piece chamber 130. A top portion 440 of game board chamber 120 may be configured to rotate along an axis parallel and proximate to top portion 250 of the modular game case 110 such that if the modular game case 110 is in an open position, the game board chamber may also be placed in an open position and accessed while disposed within the modular game case. Accordingly, a user may access a game board within game case 110 while game board chamber 120 is within game case 110.

Furthermore, top portion 440 of game board chamber 120 may include a plurality of slots 410(*a*)-(*d*). Each slot 410 (*a*)-(*d*) may be configured to receive a removable label. Each removable label may be associated with a stored game board within game board chamber 120.

Figure 5:
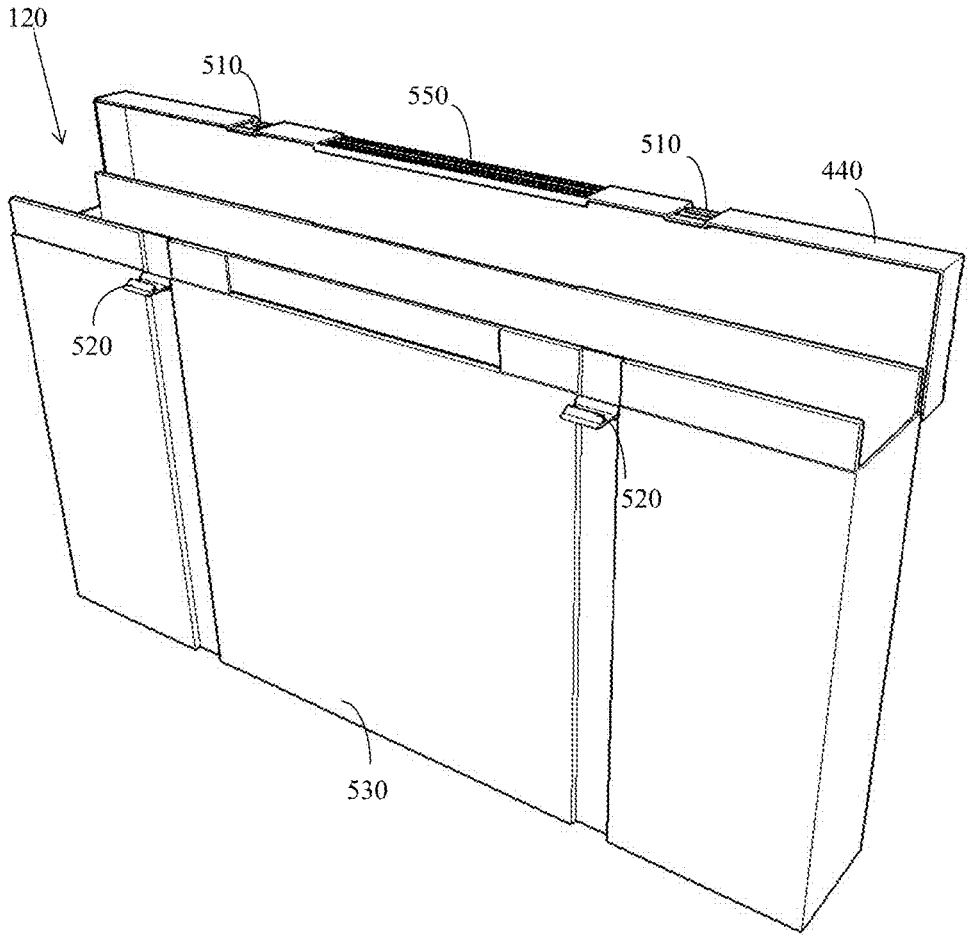
FIG. 5 depicts an embodiment of a game board chamber in an open position.
Figure 6:
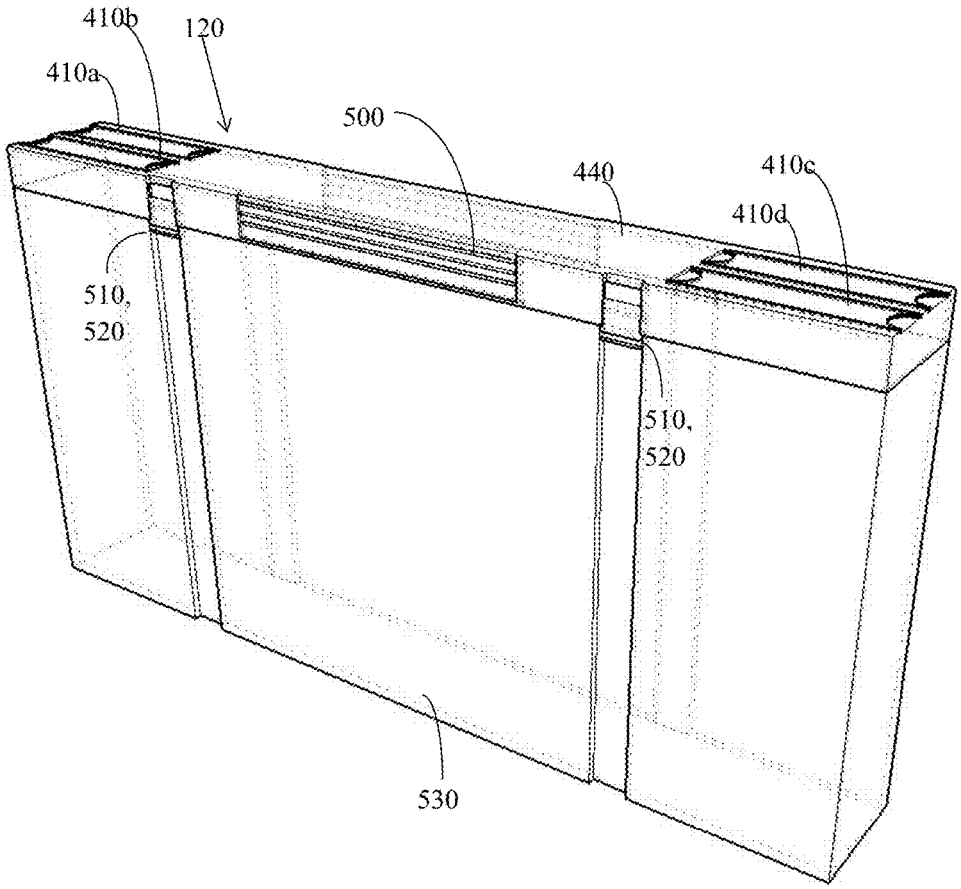
FIG. 6 depicts an embodiment of a game board chamber in a closed position.

If modular game case 110 is in an open position (as shown in FIGS. 4 and 5) game board chamber 120 may be configured such that top portion 440 of the game board chamber 120 protrudes or extends from bottom portion 205 of modular game case 110. If modular game case 110 is in a closed position (as shown in FIG. 6) the top portion 440 of game board chamber 120 may be configured such that the top portion 440 of the game board chamber fits within top portion 250 of modular game case 110.

A horizontal surface of the top portion 440 may include notches, grooves, scores or ribbing 430 for gripping so a user may more easily remove and/or insert game board chamber 120 within modular game case 110 while other chambers are within modular game case 110.

Game piece chambers 130 may be disposed side by side along a horizontal surface of modular game case 110. Each game piece chamber 130 may be configured to be inserted and removed from modular game case 110. While disposed in modular game case 110, side protrusion 134 may be projected outward from the bottom portion 205 of modular game case 110. Each side protrusion 134 may include notches, grooves, scores or ribbing 135 such that a user may more easily remove and/or insert a game piece chamber within modular game case 110 while other chambers are within modular game case 110. On a top surface of each game piece chamber 130 may be disposed slot 132 configured to hold a removable label. The removable label may be used to identify objects, such as the pieces of games, stored within a corresponding game piece chamber 130.

FIG. 5 depicts game board chamber 120 in an open position. Accordingly, game boards may be inserted within or removed from game board chamber 120.

FIG. 6 depicts game board chamber 120 in a closed position. While in a closed position, game board chamber 120 may hold, store or transport various game boards. Furthermore, top portion 440 of game board chamber 120 may include scores or grooves 500 that allow for top portion 440 to be gripped and opened more easily. Top portion 440 may also include latch receiving members 510 that may be configured to couple with a corresponding latch 520 on a bottom portion 530 of game board chamber 120. More specifically, while game board chamber 120 is in an open position as depicted in FIG. 5, latches 520 and latch receiving member 510 may be uncoupled. If game board chamber 120 is in a closed position as depicted in FIG. 6, latches 520 and latch receiving member 510 may be coupled to prevent the chamber 120 from opening if dropped or bumped. Various known types of latches and latch placements may be used for this purpose.

Game board chamber 120 is depicted in FIGS. 1 and 4-6 as being constructed of a rigid material, such as a rigid plastic. Such a material may allow for easy insertion into and removal from a rigid game case, and may reduce wear on the game board chamber 120. However, in some embodiments the game board chamber is a soft-structure game board chamber 1820. A flexible, soft-structure game board chamber 1820 may be more customizable, allow for more different types of game components to be stored inside, and be more comfortable and convenient to carry by itself, apart from the modular game case 100. Soft-structure game board chambers may be made of fabric and/or other flexible materials.

FIGS. 18-25 depict embodiments of soft-structure game board chamber 1820.

Figure 18:
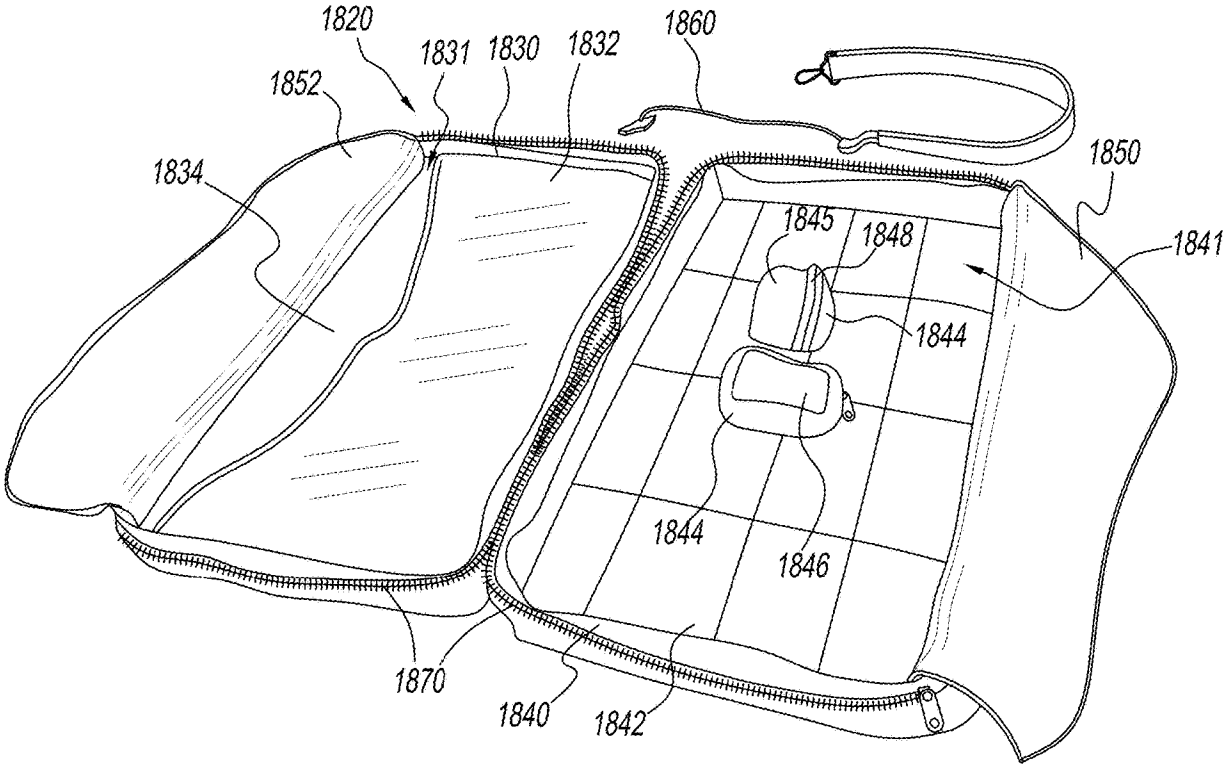
FIG. 18 depicts an embodiment of a soft-structure game board chamber in an open position.

FIG. 18 depicts an embodiment of a soft-structure game board chamber 1820 in an open position. Game board chamber 1820 splits into two halves, game board storage side 1830 and game piece storage side 1840. The two storage sides 1830, 1840 have respective interiors 1831, 1841 being spaced apart and separated from one another. Interior 1831 of storage side 1830 is configured for holding one or more game boards. Interior 1841 of storage side 1840 is configured for holding one or more game pieces. The two sides connect with zipper 1870 into a unified whole, or can be used separately with covers 1852, 1850. When unified, the covers 1852, 1850 may simply hang down the middle of the game board chamber 1820 and cover the game boards and game pieces, respectively. Shoulder strap 1860 can be used for easy carrying apart from a modular game case 110. Game board storage side 1830 has game board organizer 1832, 1834 disposed in the interior 1831 thereof for separating and securely holding game boards. Here there is a clear plastic divider/sleeve 1832 and fabric dividers/sleeves 1834. Game piece storage side 1840 has a securing mechanism in the form of a fabric surface 1842 to which hook-and-loop fasteners will adhere. Individual game piece holders 1844 have mesh uppers 1845 for easy content viewing, zipper openings 1848 and hook-and-loop backing 1846 for securing to the fabric surface 1842. Thus, the game piece holders 1842 can be easily removed, replaced, and reposition on the fabric surface 1842 as desired. If not needed, for example, game piece holders 1842 can be remove and the game piece storage side 1840 can be used for additional game board storage.

Embodiments of game board chamber 1820 have many variations of the elements illustrated in FIG. 18. Various fasteners, such as snaps, may be used in place of hook-and-loop fasteners (surface 1842 may have a grid of snaps in such embodiments). Game piece holders may come in various shapes, sizes, and materials (e.g. transparent plastic, finer mesh with smaller holes, etc.) and may have various closures. Dividers similar to those 1834 on the game board storage side with hook-and-loop or other fasteners may be removably attached to the surface 1842 to provide additional organized game board storage. The dividers 1834 may themselves be removable from game board storage side 1830 and game board storage side 1830 may accordingly have a fabric back surface or grid of snaps, etc. The dividers 1834 may also be removable attached to one another. Game board chamber 1820 may split from front to back into two halves, each having a game board storage side and a game piece storage side, instead of from side to side. These narrower halves can fit in a backpack and are very useful for games that have gameboards that fold into quarters. Various other connection means may be used instead of zipper 1870, such as snaps, mating features like clips, tabs, and/or pegs, etc.

Figure 19:
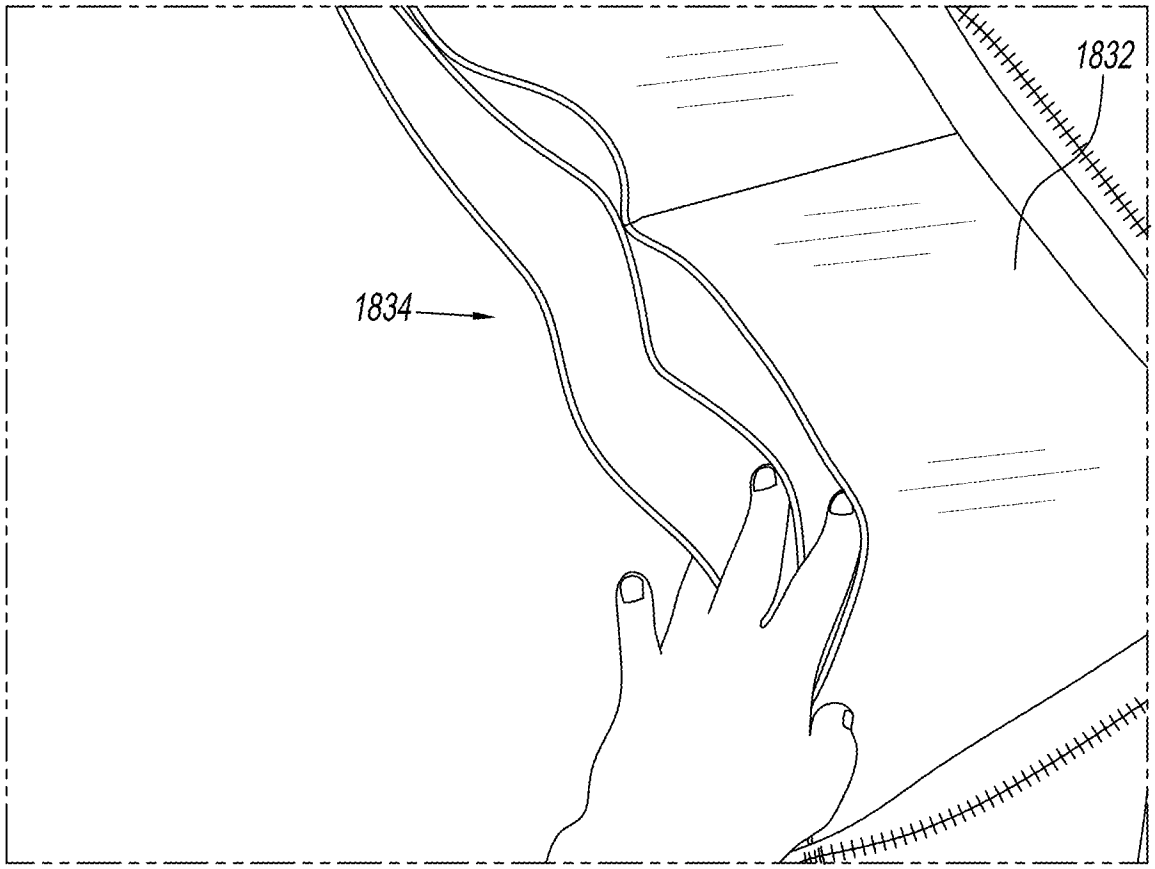
FIG. 19 depicts the game board organizer of an embodiment of a soft-structure game board chamber.

FIG. 19 depicts the game board organizer 1832, 1834 of an embodiment of a soft-structure game board chamber. Here, the individual dividers/sleeves 1834 can be clearly seen. This structure allows individual game boards to be easily identified and retrieved.

Figure 20:
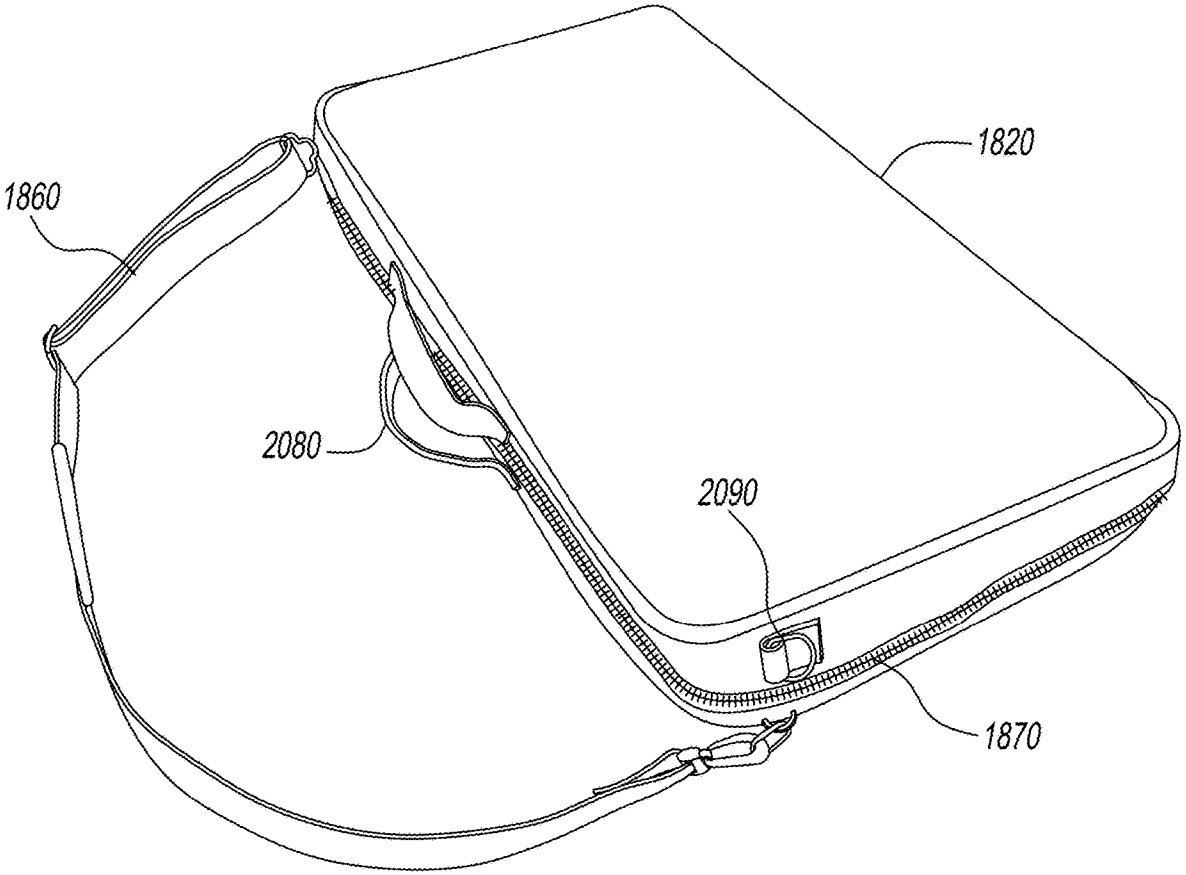
FIG. 20 depicts an embodiment of a soft-structure game board chamber in a closed position.

FIG. 20 depicts an embodiment of a soft-structure game board chamber 1820 in a closed position. Here, handles 2080 for carrying and loop 2090 for securing shoulder strap 1860 are visible. The game board chamber 1820 has two loops 2090 on each side, so that when divided into its two halves, each can have an attached shoulder strap for ease of individual transport.

Figure 21:
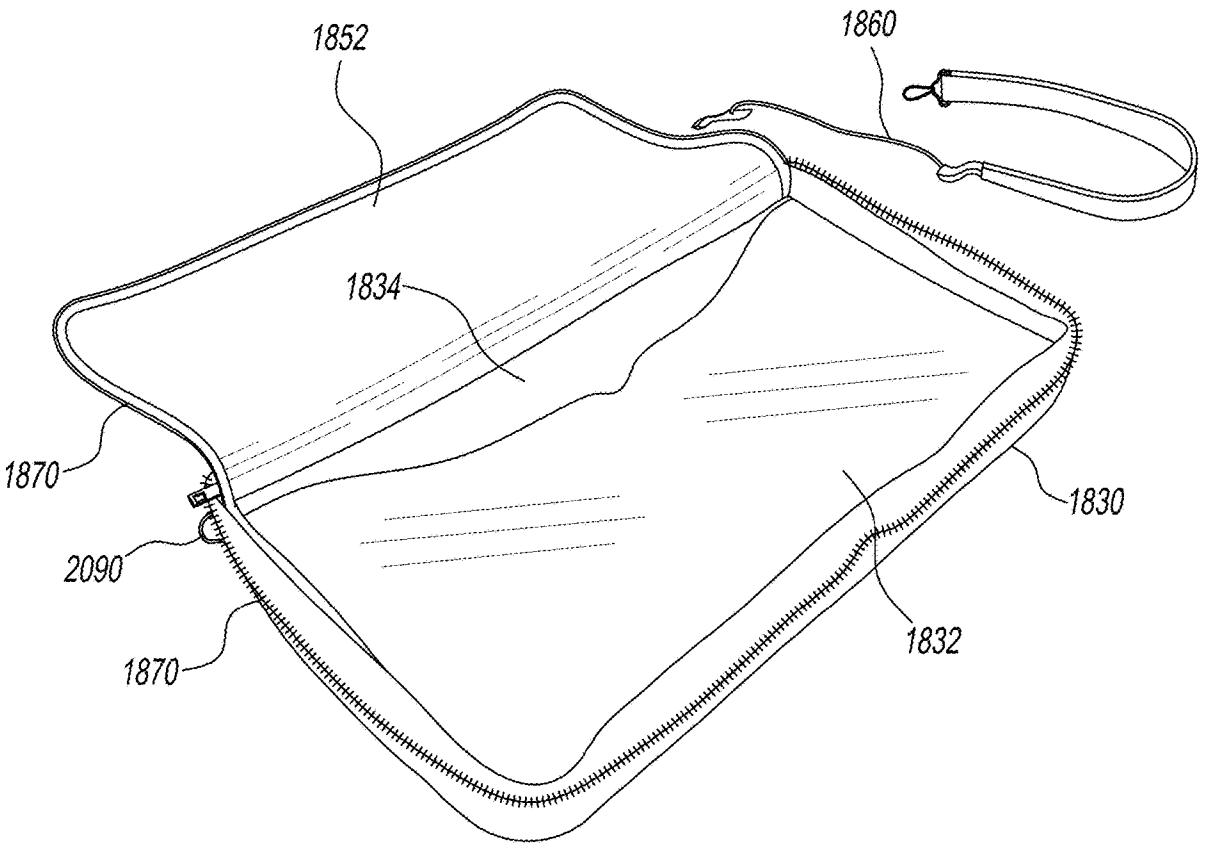
FIG. 21 depicts the game board storage side of an embodiment of a soft-structure game board chamber in an open position.

FIG. 21 depicts the game board storage side 1830 of an embodiment of a soft-structure game board chamber in an open position. Zipper 1870 extends along cover 1852, so the game board storage side can be zipped closed and used independently of game piece storage side 1840.

Figure 22:
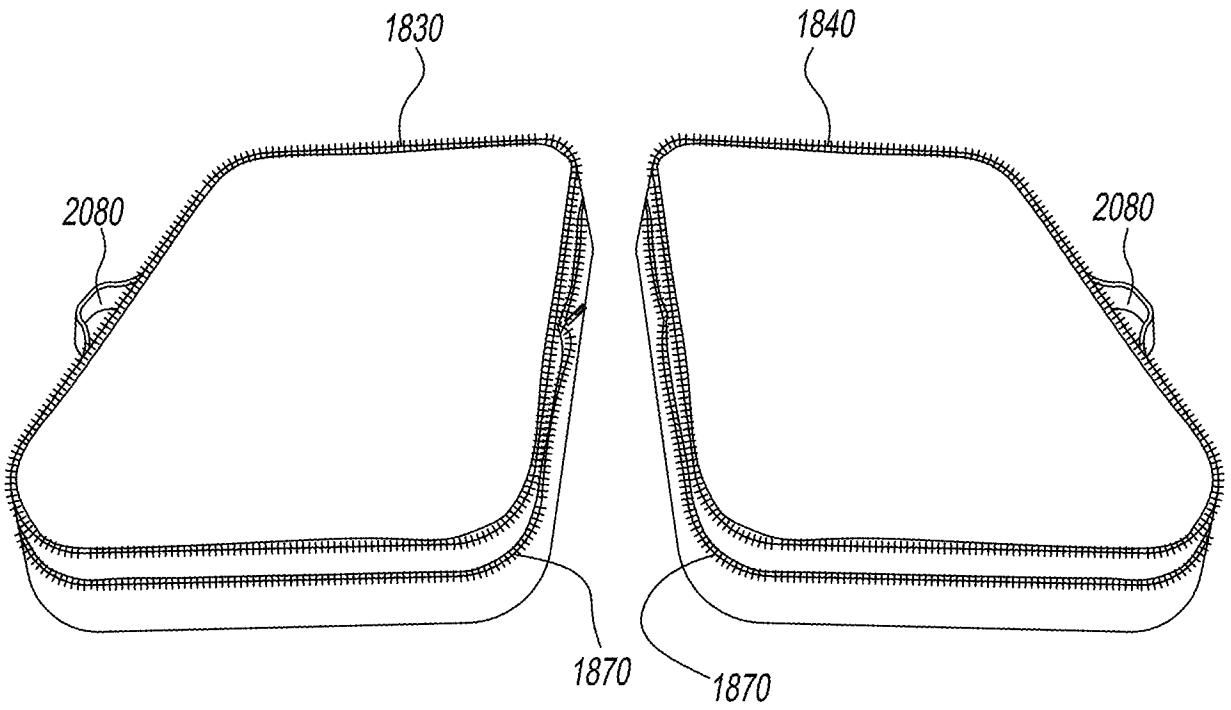
FIG. 22 depicts the game board storage side and game piece storage side of an embodiment of a soft-structure game board chamber, each side being closed for individual transport.

FIG. 22 depicts the game board storage side 1830 and game piece storage side 1840 of an embodiment of a soft-structure game board chamber, each side being closed for individual transport and having its own handle 2080.

Figure 23:
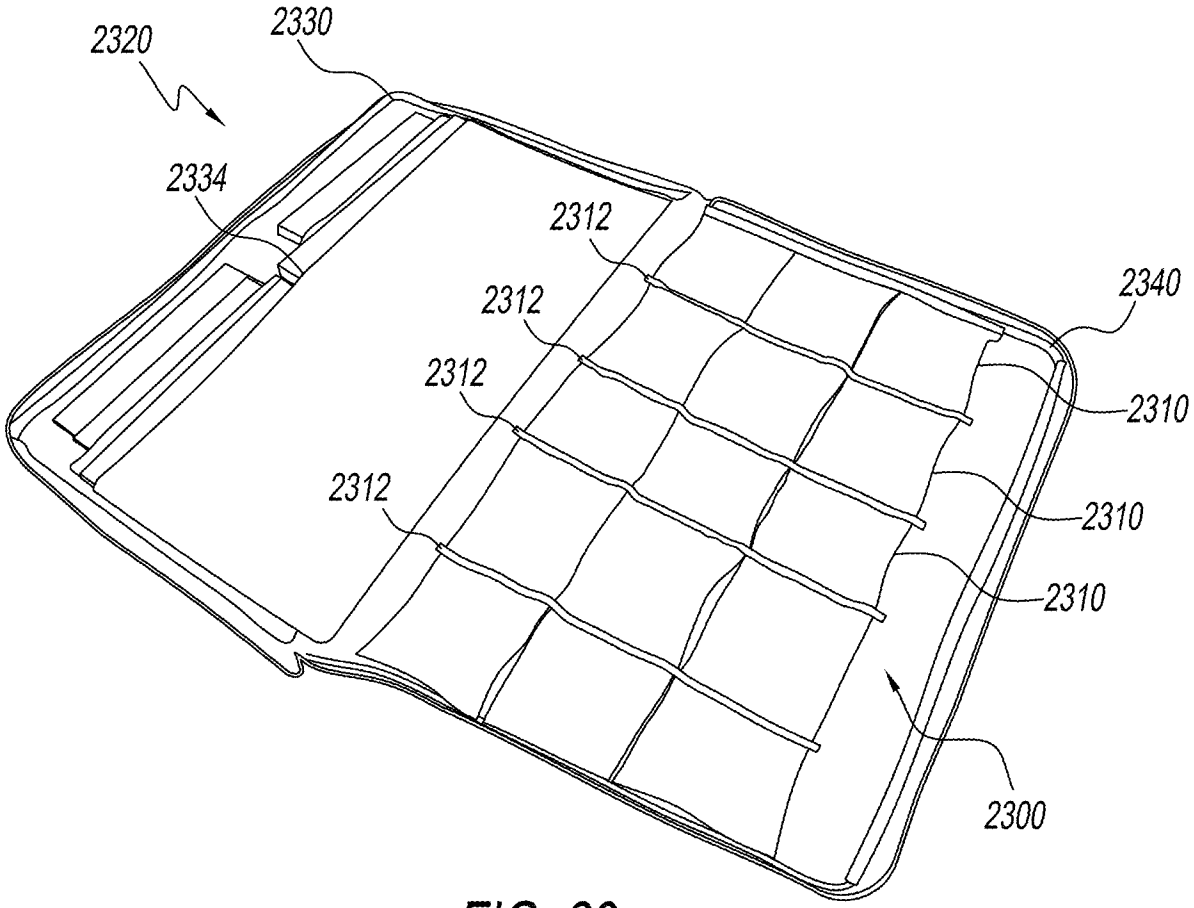
FIG. 23 depicts an embodiment of a soft-structure game board chamber in an open and flat position.

FIG. 23 depicts an embodiment of a soft-structure game board chamber 2320 in an open and flat position. The game board chamber 2320 has game board storage side 2330 and game piece storage side 2340, which zip closed and open out like a binder to lay flat, but do not separate completely. Game board storage side 2330 has dividers/sleeves 2334 for storing game boards, while game piece storage side 2340 has game piece storage compartments 2300 for storing game pieces. Game piece storage compartments 2300 are permanently attached to game piece storage side 2340 along top and bottom edges 2312, and are open on the sides 2310 for insertion of game pieces. The game piece storage compartments 2300 are made of an elastic material and expand to accommodate differently-sized game pieces while exerting a force against the inserted game pieces to hold them securely in place against the game piece storage side 2340. The game piece storage compartments 2300 are also see-through for easy identification of game pieces stored therein, and may be for example a mesh material or transparent plastic.

In embodiments, top and bottom edges 2312 may be attached to game piece storage side 2340 by various methods, such as sewing, adhesive, or fasteners such as hook-and-loop fasteners or snaps. Each game piece storage compartment may be attached individually, or some may be attached to each other, such as in rows. The game piece compartments may be attached along any number of sides (e.g. attached along all four sides, with an opening on top), or only at their corners, etc. In some embodiments, game piece compartments 1200 may be removable attached to game piece storage side 2340 for removal, replacement and repositioning, and may come in various shapes, sizes, and materials. Dividers 2334 may be removable in some embodiments as well, for customization of the size, shape, and material of divider, etc.

Figure 24:
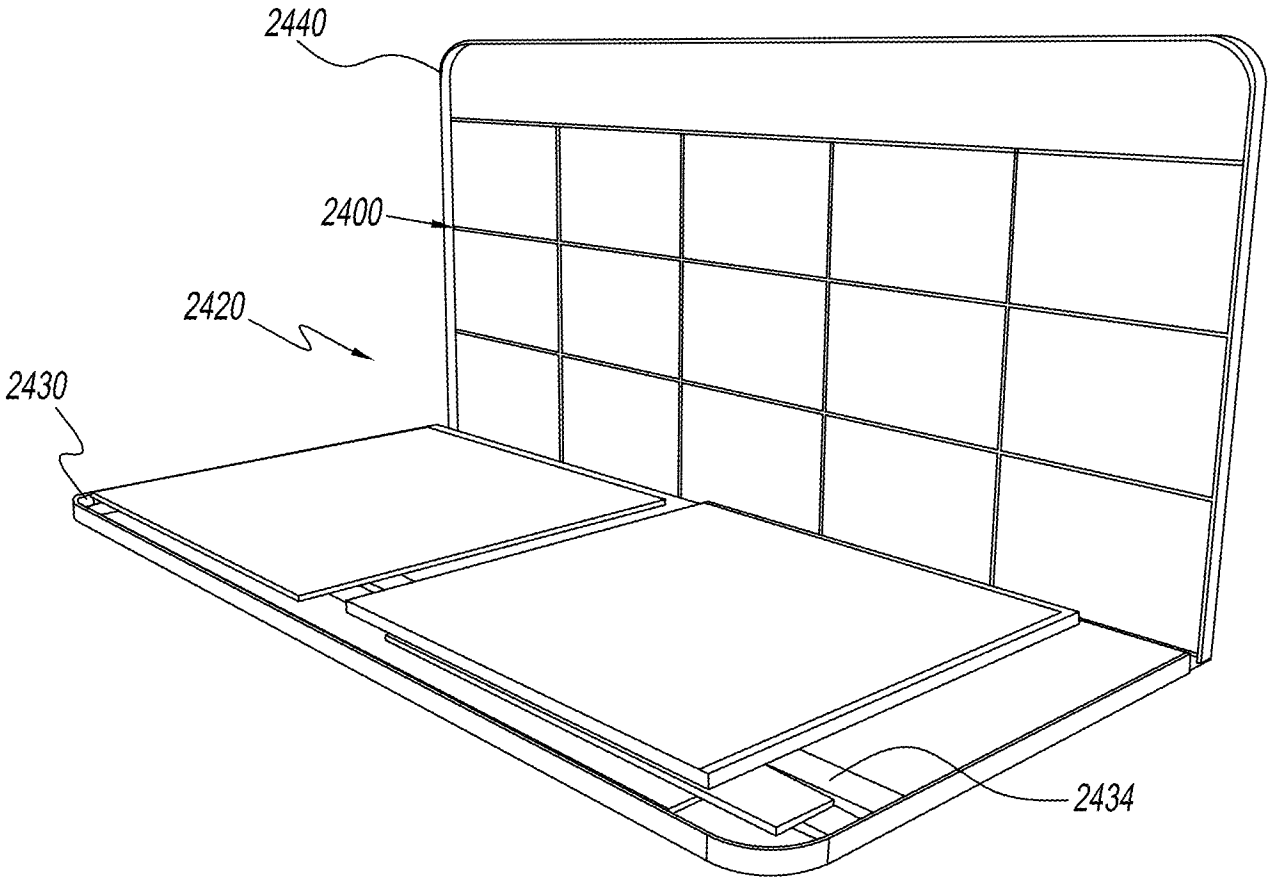
FIG. 24 depicts an embodiment of a game board chamber in an open position.

FIG. 24 depicts an embodiment of a game board chamber 2420 similar to the soft-structure game board storage chamber 2320 of FIG. 23, in an open position with game piece storage side 2440 and game board storage side 2430. Game board chamber 2420 may be made of a flexible material or may be rigid. Game board storage side 2430 has game board dividers 2434 while game piece storage side 2440 has game piece storage compartments 2400.

Figure 25:
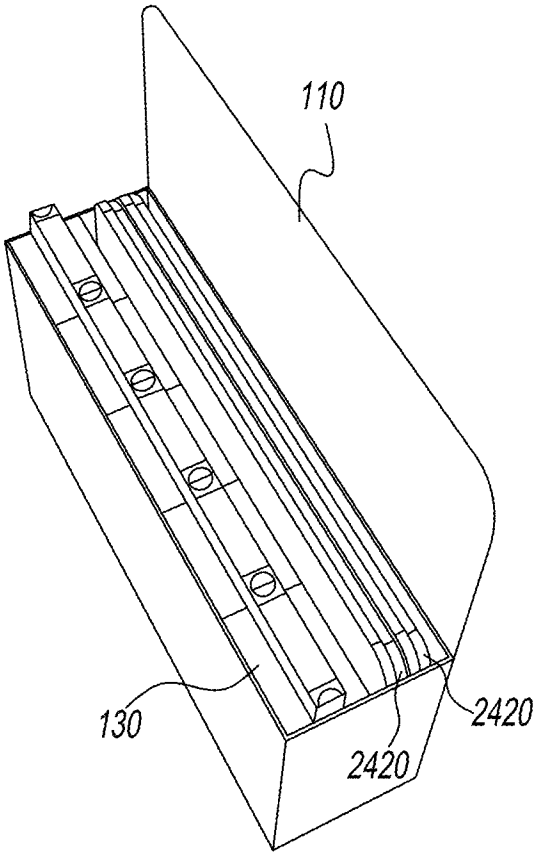
FIG. 25 depicts an embodiment of a game board chamber in a closed position and stowed in a modular game case with game piece chambers.

FIG. 25 depicts an embodiment of game board chambers 2420 in a closed position and stowed in a modular game case 110 with game piece chambers 130.

FIG. 7 depicts an example embodiment of a game piece chamber 130 in an open position. Game piece chamber 130 may be disposed within game case 110, and may be configured to hold gaming pieces of various shapes and/or sizes. Latches 730 positioned within a bottom portion 700 of game piece chamber 130 may be configured to couple with latch receivers 750 on a top portion 430 of game piece chamber 130. Accordingly, by coupling and uncoupling the latches 730 from latch receivers 750, the top portion 740 and bottom portion 700 may be fastened together and released. Any type of latch or similar fastener may be used in various embodiments. The top portion may be rotated about any type of known hinge to open and close the game piece chamber 130 so that game pieces, dividers 150, and/or game piece compartments 150 may be removed or inserted within game piece chamber 130.

Game piece chamber 130 may include railings 710*a-b* with a plurality of ridges (as depicted in FIGS. 12-17), dividers 150 and game piece compartments 140. Railings 710*a* and 710*b* may be positioned inside bottom portion 700 of game piece chamber 130, and railings 710*a* and 710*b* may have a plurality of ridges configured for receiving side protrusions 142 of the game piece compartments 140 and side protrusions 152 of dividers 150. Thus, dividers 150 and game piece compartments 140 may be mounted or disposed on the ridges on railings 710*a* and 710*b*. More specifically, railings 710*a* and 710*b* may extend from a first horizontal side 136 of game piece chamber 130 to a second horizontal side 139 of game piece chamber 130. Enough space may be left between each of the railings 710*a* and 710*b* and between the ridges and the sides 136, 139 so that side protrusions 152 of dividers 150 and side protrusion 142 of game piece compartments may hook, latch, or be mounted on the ridges within railings 710*a* and 710*b*.

More so, dividers 150 and/or game piece compartments 140 may be disposed or mounted along the ridges on railings 710*a* and 710*b* to form partitions within bottom portion 700 of game piece chamber 130, and game piece objects may be placed within the partitions. Dividers 150 and game piece compartments 140 may be removed from game piece chambers and/or placed in varying configurations within game piece chamber 130. As such, the partitions within game piece chamber 130 may be changed, and accordingly have different sizes. For example, in one embodiment dividers 150 may form a first partition that is the size of a deck of cards, and in another embodiment the first partition or a second partition may be a size to store dice. Dividers 150 and game piece compartment 140 may extend from a bottom surface 138 of game piece chamber 130 to the top portion 740 of game piece chamber 130 when it is in a closed position. Accordingly, if the top 740 of the game piece chamber 130 is in a closed position, and game piece chamber 130 is turned, rotated, and/or flipped to be in a sidewise or upside down position, the game objects within game piece chamber do not fall out of their respective compartments or partitions. If small objects are placed between dividers having notches/finger slots, they may leave their partition through these notches when the game piece chamber is shaken. However, such small objects may be placed in bags or pouches or stored in small game piece compartments or between dividers without notches to avoid that problem.

Further, along horizontal side 136 of game piece chamber 130 there may be side protrusion 134. Side protrusion 134 may be configured to extend out from a bottom area of modular game case 110 while game piece chamber 130 is disposed within modular game case 110. Side protrusion 136 may include notches or scores in parallel so that an individual may more easily grasp and hold game piece chamber 130 for insertion, removal and transportation. Side protrusion 136 may also include slot 132 that may be configured to receive a removable label. The removable label may be used to identify the objects within game piece chamber 130.

Turning to FIG. 8, FIG. 8 depicts a more detailed view of a Divider 150 that may be placed within bottom portion 700 of game piece chamber 120. Each divider 150 may include side projections 152 that are configured to seat between or be disposed between the ridges on railings 710*a*, 710*b* and a wall of game piece chamber 130. As such, dividers 150 may be secured within game chamber 130 to form partitions within game piece chamber 130. Each of the dividers 150 may include a notch or space 154. Notch 154 may be configured for easier retrieval of cards, game pieces, or other objects stored within the partitions, even if tightly packed, while game piece chamber 130 is in an open position. In various embodiments, the notch 154 may be various sizes and shapes depending on the types of objects to be stored between dividers. In some embodiments, for example for use with small objects, the notch 154 may be eliminated. Each of the dividers 150 may also include a slot 156 configured to hold a removable label. Furthermore, a top surface 800 of each divider 150 may be configured to be near or adjacent to top portion 740, if the divider is disposed within game piece chamber 130, and game piece chamber 130 is in a closed position. Accordingly, movement of gaming objects in a partition of dividers 150 and/or game piece compartment 140 of a closed gaming piece chamber 130 may be limited, reduced or prevented.

Figure 10:
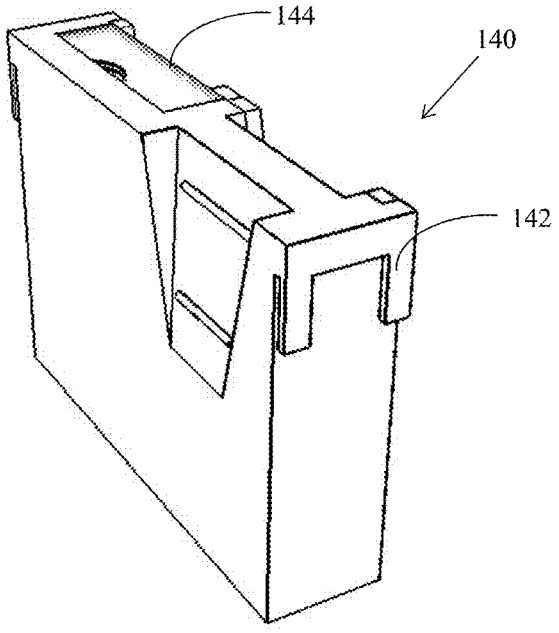

Turning to FIGS. 9 and 10, FIGS. 9 and 10 depict a more detailed view of a game piece compartment 140. Game piece compartment 140 may include side projections 142 that are configured to seat between or be disposed between the ridges on railings 710*a-b* within the game piece chamber 130. As such, game piece compartment 140 may be secured within game chamber 130.

Each game piece compartment 140 may have two sub-chambers 930 and 940 with corresponding sliding covers 910, 920. Sub-chamber 930 may have a first side that includes a slot 144, wherein slot 144 may form a side wall of sub-chamber 930, and is configured to hold a removable label that may describe the contents within game piece compartment 140. Further, Sub-chamber 930 may be respectively larger than sub-chamber 940, and thus may store or hold larger game pieces than sub-chamber 940.

Sliding covers 910 and 920 may be configured to slide on game piece compartment 140 to secure gaming objects within sub-chambers 930, 940 within game piece compartment 140, respectively. More so, the sliding covers 910, 920 may also be configured to slide off game piece compartment 140 so a user may place gaming objects within sub-chambers 930, 940, respectively. Sliding covers 910 and 920 may include scores or grooves 950 to allow for easier removal of the covers 910, 920. Sliding cover 920 and sub-chamber 940 may include notch 146. Notch 146 may be an indentation within game piece compartment 140 that is positioned such that if game objects or pieces are placed between game piece compartment 140 and a divider 150, the game objects or pieces may be easily retrieved and grasped through notch 146.

Figure 11:
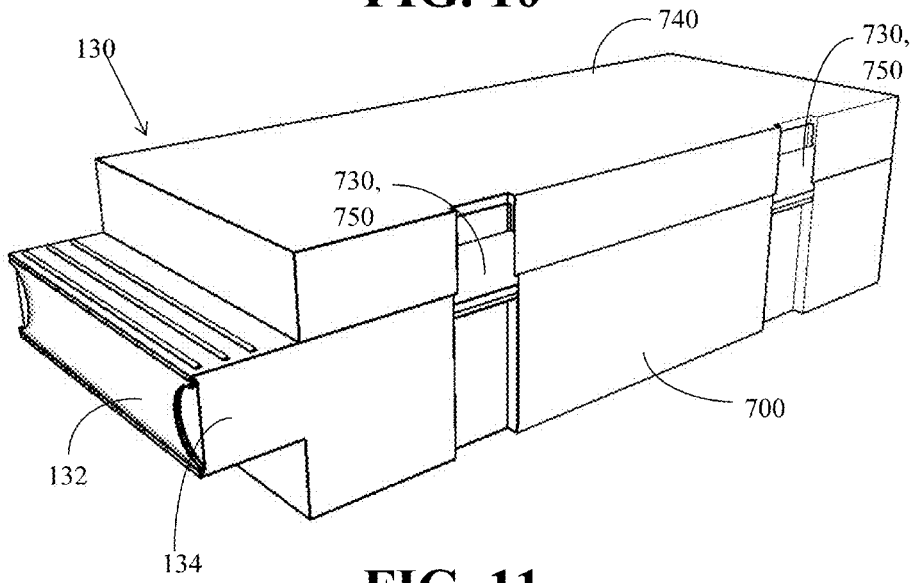
FIG. 11 depicts an embodiment of a game piece chamber in a closed position.

FIG. 11 depicts an example embodiment of game piece chamber 130 in a closed position. Inside of game piece chamber 130 may be dividers 150, game piece compartments 140, and/or gaming objects. While in a closed position, latches 730 may couple with latch receivers 750 to securely close game piece chamber 130, so that game piece objects within game piece chamber 130 remain inside game piece chamber 130.

Figure 12:
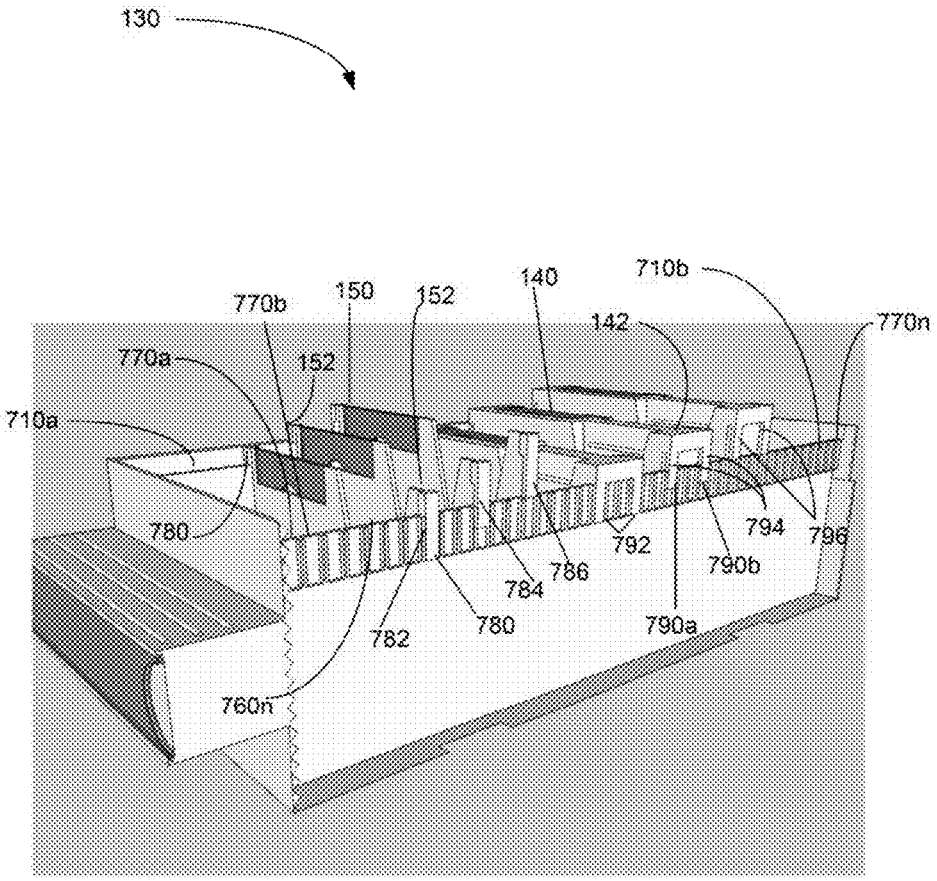
FIG. 12 depicts an embodiment of a game piece chamber with a transparent wall to illustrate a ridge system.

FIG. 12 depicts an example embodiment of game piece chamber 130. More specifically, FIG. 12 depicts a game piece chamber 130 with a transparent side to illustrate railing 710*b* with a plurality of ridges 770*a-n*, dividers 150 and game case compartments 140.

Figure 15A:
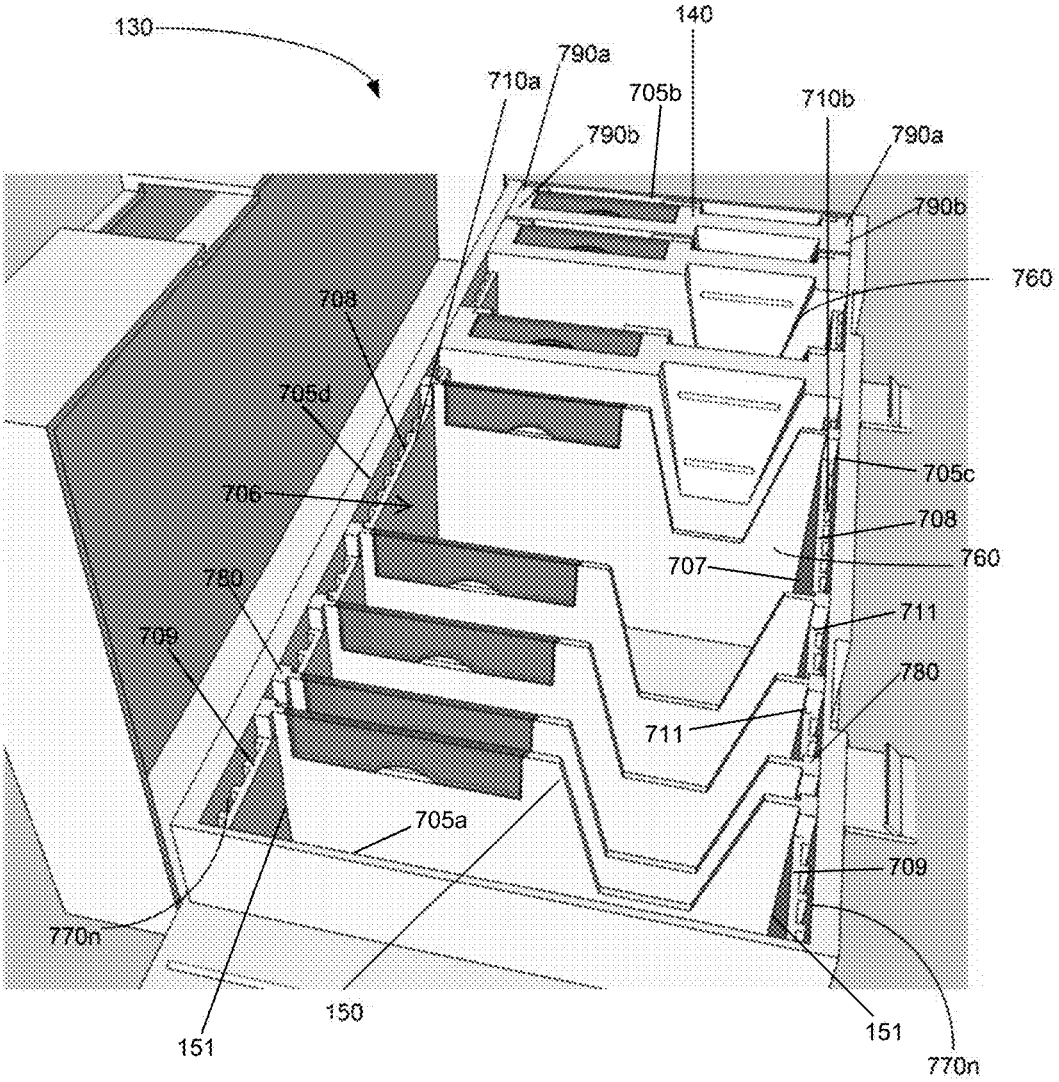
FIGS. 15*a-b*, 16*a-c*, and 17 depict embodiments of a game piece chamber with dividers and game piece compartments having various positioning.
Figure 15B:
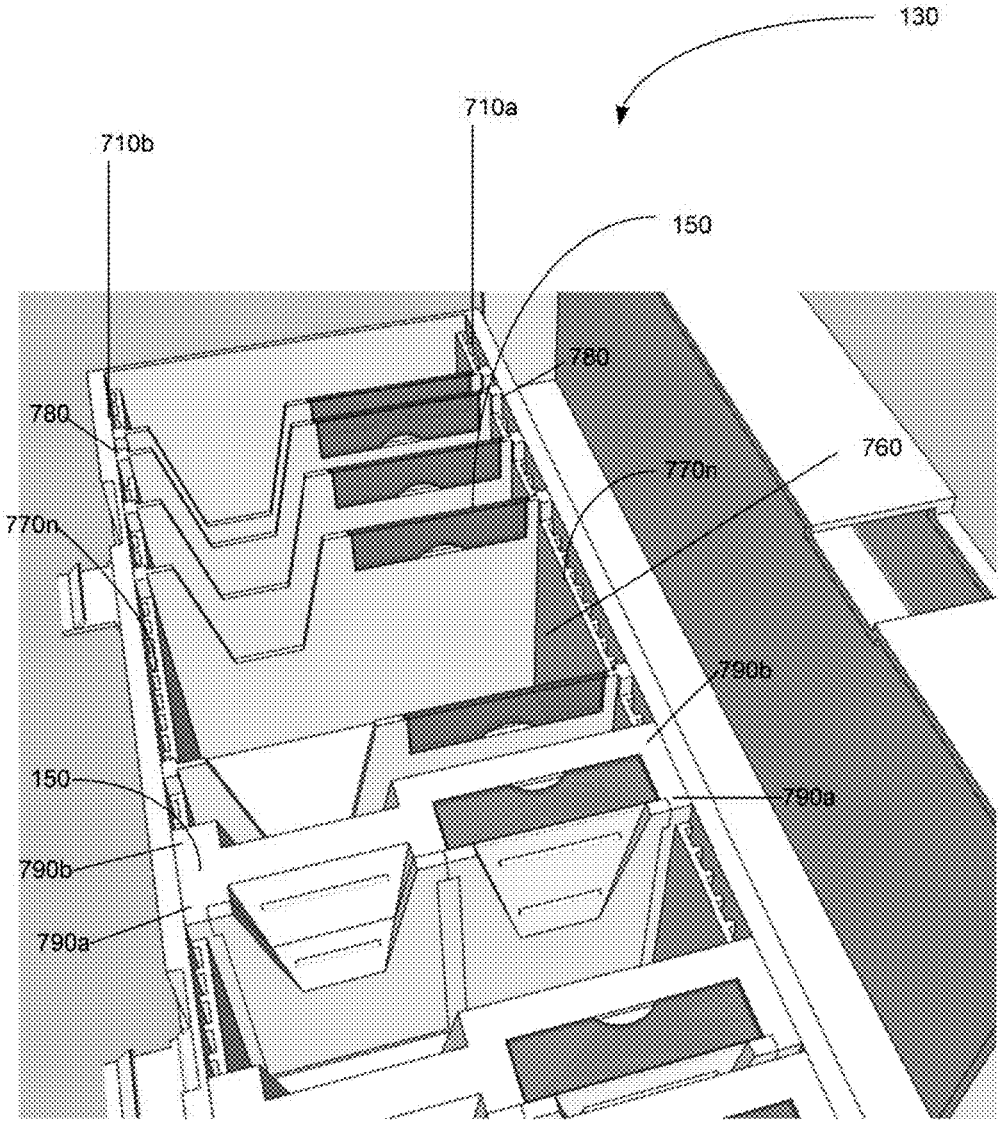
Figure 16A:
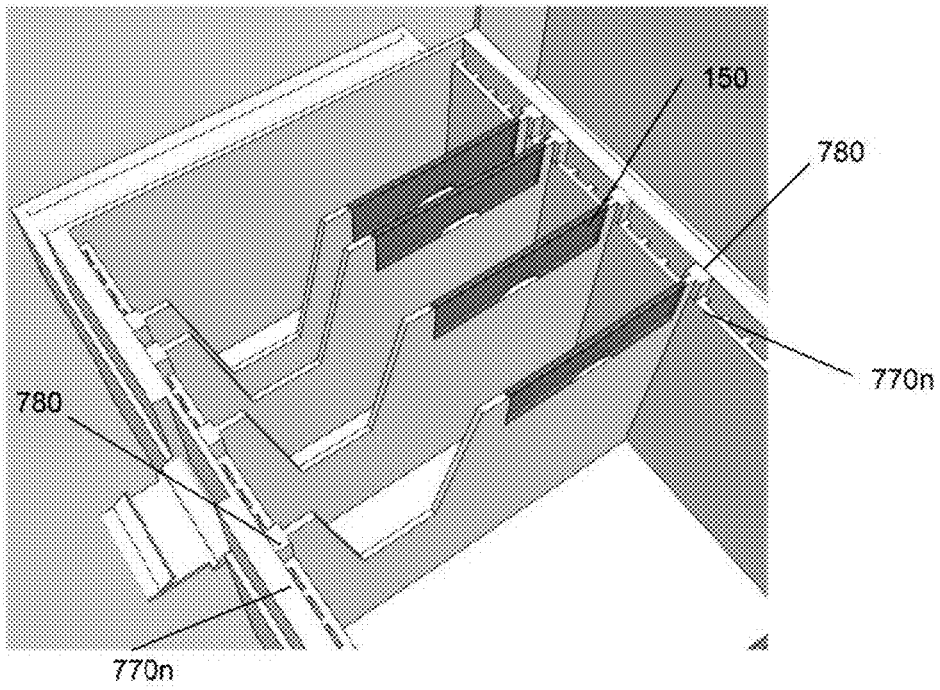
Figure 16B:
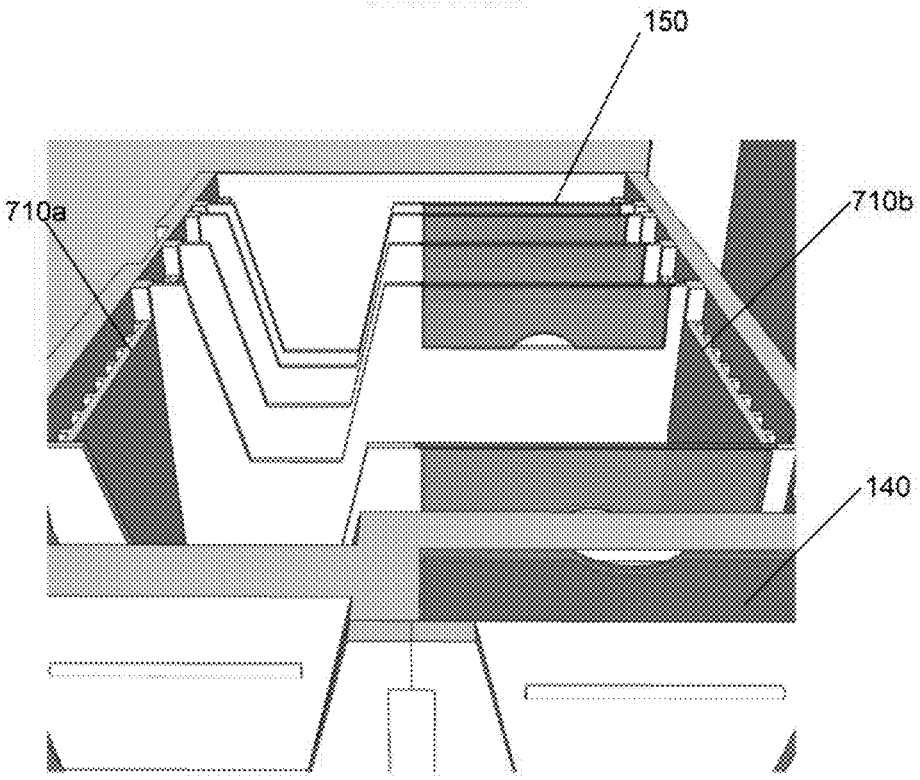
Figure 16C:
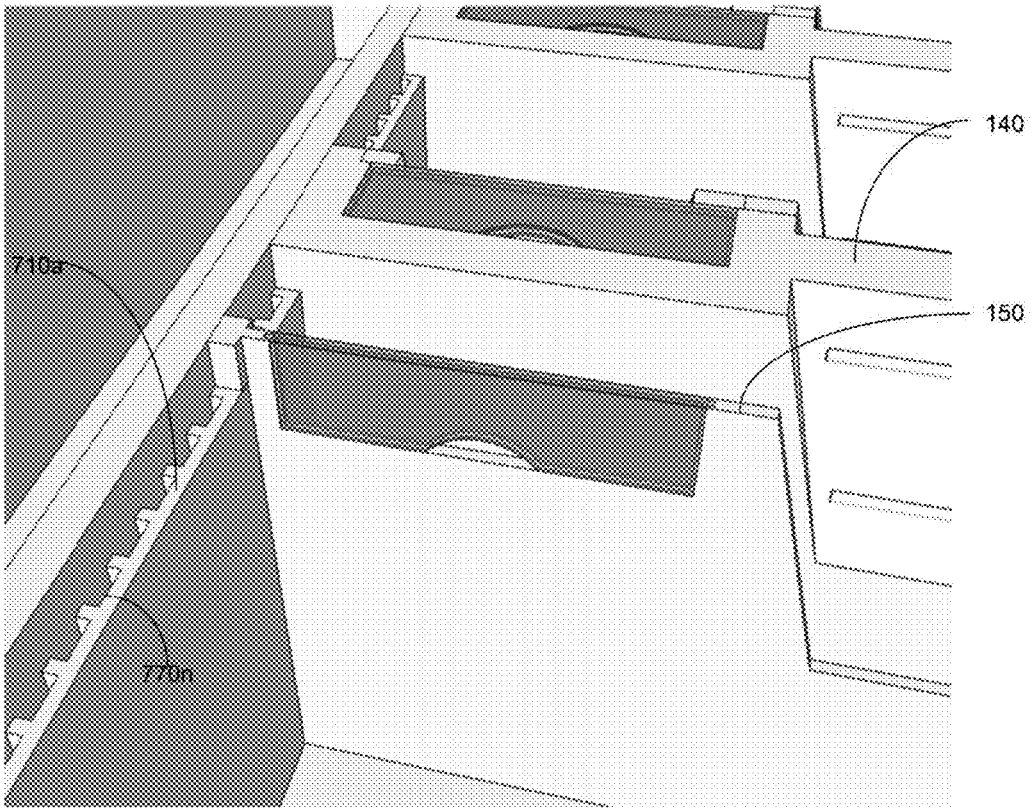
Figure 17:
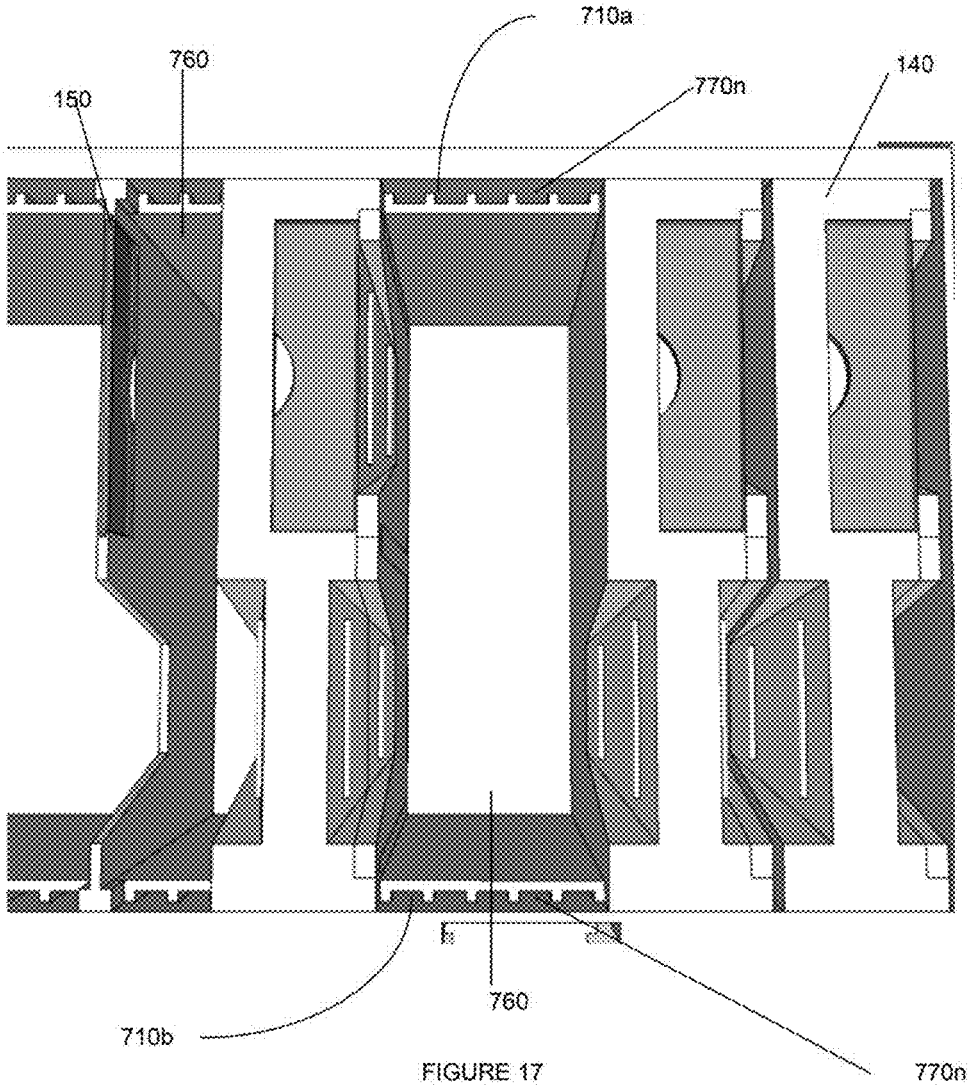

Disposed along each of the railings 710*a* and 710*b* there may be a plurality of ridges 770*a-n*. Ridges 770*a-n* may be uniformly shaped and positioned adjacent and spaced apart in relation to one another along each of the railings 710*a* and 710*b*. More so, each pair of the ridges 770*a-n* may be configured to receive a latch 780 disposed on projection 152 for a divider 150 or one of the latches 790*a*, 790*b* disposed on projection 142 for a game piece compartment 140. More particularly, as seen in FIG. 15A, the game piece chamber 130 includes spaced apart opposing front and rear surfaces 705*a-b*, a pair of spaced apart opposing side surfaces 705*c-d* extending between the front and rear surfaces 705*a-b*, and an interior 706 defined between the front, rear and side surfaces of the game piece chamber 130. The pair of opposing railings 710*a-b* are attached to and extend in parallel with one another between the front surface 705*a* and the rear surface 705*b*. Each railing 710*a-b* is spaced from a corresponding one of the side surfaces 705*c-d* into the interior 706 of the game piece chamber 130. Each railing 710*a-b* has an inner surface 707 facing toward the interior 706 and an outer surface 708 adjacent to, spaced from and facing toward one of the side surfaces 705*c-d*. A plurality of the spaced apart ridges 770*n* are attached to the outer surface 708 of each of the railings 710*a-b* and extend downward from adjacent a top edge 709 toward a bottom edge of each of the railings 710*a-b* and also protrudes toward the corresponding one of the opposing side surfaces 705*c-d* of the game piece chamber 130.

Each divider 150 is configured to be removably placed in the interior 706 of the game piece chamber 130 between the inner surfaces 707 of the opposing railings 710*a-b*. Each divider 150 may have projections 152 with latches 780 positioned on both of the opposing sides 151 of the divider 150. Each projection 152 is configured to extend beyond the top edge 709 of a corresponding one of the railings 710*a-b* and its latch 780 to extend downward and seat between a respective pair of ridges 770*a-n* on the outer surface 708 of a respective one of the railings 710*a-b*. Each latch 780 also defines a gap 711 between the latch 780 and a respective one of the two opposing sides 151 of the divider 150 such that at least an upper portion of a respective one of the opposing railings 710*a-b* adjacent the top edge 709 thereof is disposed in the gap 711, with each of the two opposing sides 151 of the divider 150 being configured for positioning adjacent to the inner surface 707 of a respective one of the spaced apart opposing side railings 710*a-b*. Accordingly, latches 780 on the projections 152 on opposing sides of divider 150 may be configured to be disposed in corresponding pairs of ridges 770*a-n* along railings 710*a* and 710*b*. If latches 780 of divider 150 are disposed within corresponding ridges 770*a-n*, divider 150 is thusly secured within game piece chamber 130. As one skilled in the art would understand, in other example embodiments to provide more stability for a divider 150, each divider may have more than one latch 780 on each side of divider 150.

Each game piece compartment 140 may have projections 142 with latches 790*a* and 790*b* on both sides of game piece compartment 140. Accordingly, projections 142 with the latches 790*a* and 790*b* on each side of game piece compartment 140 may be configured to be disposed in corresponding ridges 770*a-n* along railings 710*a* and 710*b* substantially in the same manner as describe above with respect to the projections 152 with the latches 780 on the dividers 150. If latches 790*a* and 790*b* are disposed within corresponding pairs of ridges 770*a-n*, game piece compartment 140 is thusly secured within game piece chamber 130. Although FIG. 12 depicts each game piece compartment 740 with multiple latches 790*a* and 790*b* on each side of game piece compartment 740, in other embodiments each game piece compartment 740 may only have a single latch on each side to conserve space within game piece chamber 130.

For further stability, additional securing mechanisms may be provided in various embodiments. For example, grooves may be provided along the bottom and/or side of the game piece chamber 130 in line with the ridges 770*n*, and the dividers 150 may slide into the grooves. Game piece compartments 140 may have ridges on their bottoms for mating with such grooves. Being secured at the bottom as well as the top makes the dividers 150 less likely to be bent, broken or dislodged during transport and while separating various types of game pieces, which may be heavy.

Dividers 150 and game piece compartments 140 may be moved or placed in various configurations within corresponding ridges 770*n* in game piece chamber 130 to vary the sizing of partitions 760*n*. More so, positions 782, 784 and 786 show various stages of positioning of a latch 780 within a corresponding ridge 770*n*. At position 782, divider 150 may be fully secured and positioned within game piece chamber 730. At position 786, divider 150 may be either being inserted or removed from a corresponding ridge 770*n*. At position 784, divider 150 may be transitioning from being inserted or removed from a corresponding ridge 770*n*. Similarly, position 792 corresponds to a game piece compartment 740 that is inserted within a game piece chamber 130, position 796 depicts a game piece compartment 140 that is either being removed or inserted into a corresponding ridge 770, and position 294 depicts a game piece compartment that is transitioning from being removed or inserted into corresponding ridges 770*n*.

In various embodiments of game piece chamber 130, more or fewer ridges 770*n* may be provided, with more or less space between them. Many different systems may be used for securing and positioning the dividers 150 and game piece compartments 140 within game piece chamber 130. For example, the ridge 770 and latches 780, 790 may be reversed so that the ridges project outwards into a cavity in the game piece compartments 140 and dividers 150. Hook and loop fasteners, snaps, or other fasteners may be used. In some embodiments, the ridges are removable and repositionable for further customization. For example, the ridges could be attached to railings 710*a,b* by hook and loop fasteners (with a strip of fabric or similar extending along the railings). In some embodiments, ridges may not be used and the dividers 150 and game piece compartments 140 may have frictious hooks that hook over railings 710*a,b* to secure them. Since the dividers 150 and game piece compartments 140 are removable, they may be interchanged with dividers, compartments, and other parts with various sizes, shapes, and materials.

Figure 13:
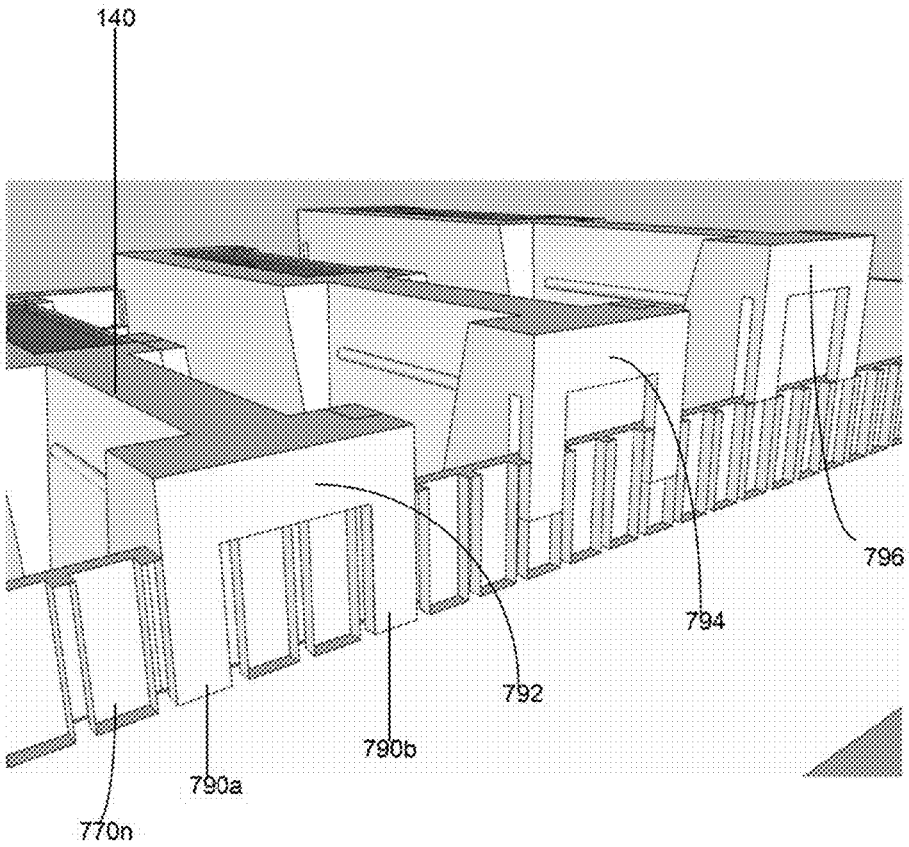
FIG. 13 depicts an embodiment of a game piece compartment with latches and a corresponding ridge system.
Figure 14:
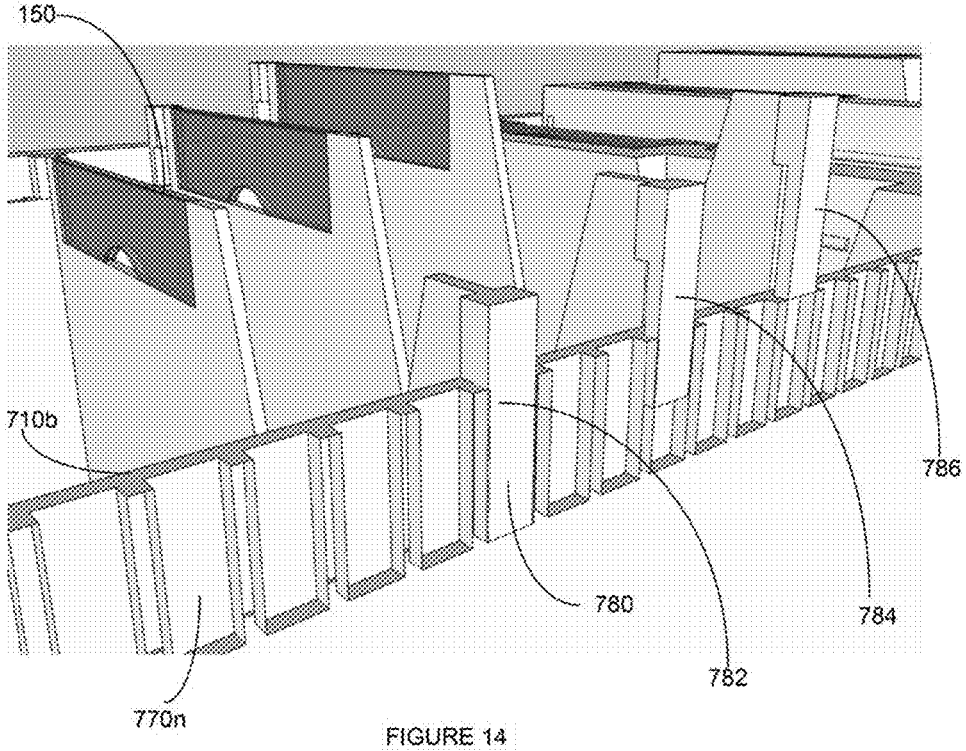
FIG. 14 depicts an embodiment of a divider with latches and a corresponding ridge system.

FIG. 13 depicts a more detailed view of latches 790*a* and 790*b* of game piece compartments 140 being positioned within corresponding ridges 770*n*. FIG. 14 depicts a more detailed view of latches 780 of dividers 150 being positioned within corresponding ridges 770*n*. As one skilled in the art will appreciate, latches 790*a*, 790*b* and 780 are configured to be received by ridges 770*n*, and in other embodiments latches 790*a*, 790*b* and 780 and ridges 770*n* may be any desired or required shape or size.

FIGS. 15*a-b*, 16*a-c* and 17 depict various views of game piece compartments 140 and dividers 150 disposed in various positions within game piece chamber 130. Based on the positioned of game piece compartments 140 and dividers 150 within game piece chamber 130, partitions 760 may vary in size.

In other embodiments, other mounting systems may be used instead of or in addition to the railings and ridges. For example, in an alternative embodiment the ridges could project directly from the sides of the game piece chamber, and projections from the dividers and game piece compartments would fit between those ridges but not over railings. In other embodiments, any known fastening system may be used, including magnets, hook-and-loop fasteners, and any kind of mechanical latch or interlocking structure.

In one embodiment, the interior width of a game board chamber is 2⅝", the depth is 12⅛", and the length is 23⅝", and a removable padded insert for the game board chamber has an interior with of 2½", depth of 12 1/16", and length of 23½". In one embodiment, a game piece chamber has an interior length of 10 13/16", interior depth of 3", a height of 2¾" from the inside bottom to the top of the ridge system, interior width of 4¼", and width of 4" between the inner walls of the ridge system, and the ridges are 1/16" wide and there is a space of 3/16" between adjacent ridges. The size of these chambers drive the sizes of the other pieces. Most board games today are standard square and when folded up are approximately 10.25"×10.25"×0.5".

The game board chamber as sized above allows two of these boards to stand vertically side by side (and up to five back to back without rule books). Many legacy board games use a standard rectangular board that is approximately 20"×10"×0.2" when folded, and these boards also fit well with the example dimensions above. Depending on the mix of boards, 4-6 or more boards plus rule books can be stored easily with the above dimensions.

The game piece chamber dimensions above are the result of an analysis of the card sizes in use for popular games today. The game piece chamber is large enough to hold the most popular card sizes between dividers without the cards having much room to slide around and be damaged or become disorganized. Smaller cards and objects can be stored in the game piece compartments. Many popular games use cards between 2.2" and 2.76" in length and between 2.76" and 3.58" in width. These fit tightly within the game piece chamber in the above embodiment, which is 2¾" in height and 4" in width, with generally ½" or less in either dimension to move around within the chamber. Other popular cards are smaller, <2" in length and around 2.5" in width, and may be stored in the small game piece compartments to avoid sliding. Finally, some games use cards with a width>4", which can be stored sideways.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments. While the embodiments may be illustrated by using a particular embodiment, this is not and does not limit the invention to any particular embodiment and a person of ordinary skill in the art will recognize that additional embodiments are readily understandable and are a part of the example embodiments.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What we claim is:

1. A game piece chamber, comprising:

spaced apart opposing front and rear surfaces, a pair of spaced apart opposing side surfaces extending between the front and rear surfaces, and an interior defined between the front, rear and side surfaces;

a pair of spaced apart opposing railings attached to, and extending in parallel with one another between, the front surface and the rear surface, each railing being spaced apart from one of the side surfaces into the interior and having an inner surface facing toward the interior and an outer surface adjacent to, spaced apart from and facing toward one of the side surfaces;

a plurality of spaced apart ridges attached to the outer surface of each of the railings and extending downward from adjacent a top edge toward a bottom edge of the outer surface of each of the railings and also protruding toward the corresponding ones of the opposing side surfaces; and one or more dividers configured to be removably placed in the interior between the inner surfaces of the opposing railings, each of the dividers comprising at least one projection on each of two opposing sides of each of the dividers, each projection being configured to extend beyond the top edge of a respective one of the railings and seat between a respective pair of the ridges and also between and relative to the outer surface of a respective one of the railings and the one side surface adjacent and spaced apart from the outer surface of the one railing to removably secure the dividers in the interior in order to organize game pieces stored in the interior, said seating and securing being such that each of the one or more dividers is prevented from moving in a longitudinal direction between the front and rear surfaces when the removable divider is so seated and secured.

2. The game piece chamber of claim 1, further comprising a side protrusion extending outward from an opposite side of the front surface away from the interior and being configured for easy gripping and removal of the game piece chamber from within containers.

3. The game piece chamber of claim 1, wherein each of the two opposing sides of each divider is configured for positioning adjacent to the inner surface of one of the spaced apart railings.

4. The game piece chamber of claim 1, wherein the projections each have one or more latches disposed thereon being configured to extend downward and seat between the respective one or more of the pairs of ridges and define a gap between each latch and a respective one of the two opposing sides of the divider such that at least an upper portion of a respective one of the opposing railings is disposed within the gap between each latch and the respective one of the two opposing sides of the divider.

5. The game piece chamber of claim 1, wherein the dividers comprise notches for easy gripping and removal of the dividers from the interior.

6. The game piece chamber of claim 1, wherein the dividers and the ridges on the opposing railings are configured such that the dividers may be removably secured thereto at multiple positions to provide for multiple configurations of the interior.

7. The game piece chamber of claim 6, wherein the multiple configurations of the interior have differently-sized partitions.

8. The modular gaming case of claim 6, wherein a distance in the longitudinal direction between consecutive ones of the multiple positions is equal in each instance where consecutive ones of the multiple positions exist.

9. The game piece chamber of claim 7, wherein the size of at least one of the partitions is based on at least one gaming object.

10. The game piece chamber of claim 1, wherein at least one of the dividers comprises an internal chamber.

11. The game piece chamber of claim 10, wherein the internal chamber comprises sub-chambers; and wherein at least one of the dividers comprises removable sliding covers, each removable sliding cover being configured to cover a corresponding sub-chamber.

12. The game piece chamber of claim 1, further comprising an external removable label on each divider.

13. A modular gaming case comprising the game piece chamber of claim 1, wherein the rear surface of the game piece chamber is adjacent to a bottom of the modular gaming case.

14. The modular gaming case of claim 1, wherein the interior is large enough to contain a standard square folded board game board.

15. The modular gaming case of claim 1, wherein the interior is large enough to contain an object that measures ten and one quarter inches by ten and one quarter inches by one half of an inch.

16. A game board chamber, comprising:

a front side and a rear side;

a first storage side extending between the front side and the rear side and comprising an interior being configured for holding one or more game boards;

a second storage side extending between the front side and the rear side and comprising an interior being configured for holding one or more game pieces, the respective interiors of the first and second storage sides being spaced apart and separated from one another without utilizing a game board being held therein as a structure to separate the respective interiors from one another, at least the second storage side also comprising a first securing mechanism disposed in the interior thereof;

one or more game piece holders configured for removable attachment to, and repositioning on, the first securing mechanism of the second storage side such that each of the one or more game piece holders is prevented from moving towards the front side and each of the one or more game piece holders is prevented from moving towards the rear side when the game piece holder is attached to the first securing mechanism; and a game board organizer disposed in the interior of the first storage side and being attached thereto, the game board organizer configured for separately holding game boards;

wherein the first storage side also comprises a second securing mechanism disposed in the interior thereof, the game board organizer being configured for removable attachment to the second securing mechanism.

17. The game board chamber of claim 16, wherein the game board organizer comprises one or more sleeves for holding game boards.

18. The game board chamber of claim 17, wherein at least one of the sleeves is see-through for easy identification of a game board held therein.

19. The game board chamber of claim 16, wherein the first securing mechanism comprises hook and loop fastener material and the game piece holders comprise mating hook and loop fastener material.

20. The game board chamber of claim 16, wherein the game piece holders comprise a plurality of differently-sized game piece holders, each configured to be removably attached anywhere on the first securing mechanism.

21. The game board chamber of claim 16, wherein the game piece holders are see-through for easy identification of game pieces held therein.

22. The game board chamber of claim 16, wherein the game piece holders comprise openings for easy retrieval of game pieces held therein.

23. The modular gaming case of claim 13, further comprising the game board chamber of claim 16, wherein a bottom surface of the game board chamber is adjacent to a bottom of the modular gaming case.

24. The modular gaming case of claim 23, wherein the modular gaming case and game board chamber each comprises a top surface that opens, whereby the contents of the game board chamber can be accessed without removing the game board chamber from the modular gaming case.

25. The game board chamber of claim 16, wherein the one or more game piece holders comprises a plurality of game piece holders and a distance in a longitudinal direction between the front side and the rear side separating consecutive ones of the plurality of game piece holders is equal in each instance where consecutive ones of the plurality of game piece holders exist.

26. The game board chamber of claim 16, wherein the interior is large enough to contain a standard square folded board game board.

27. The game board chamber of claim 16, wherein the interior is large enough to contain an object that measures ten and one quarter inches by ten and one quarter inches by one half of an inch.

28. A game board chamber, comprising:

a front side and a rear side;

a first storage side extending between the front side and the rear side and comprising an interior being configured for holding one or more game boards;

a second storage side extending between the front side and the rear side and comprising an interior being configured for holding one or more game pieces, the respective interiors of the first and second storage sides being spaced apart and separated from one another without utilizing a game board being held therein as a structure to separate the respective interiors from one another, at least the second storage side also comprising a first securing mechanism disposed in the interior thereof;

one or more game piece holders configured for removable attachment to, and repositioning on, the first securing mechanism of the second storage side such that each of the one or more game piece holders is prevented from moving towards the front side and each of the one or more game piece holders is prevented from moving towards the rear side when the game piece holder is attached to the first securing mechanism; and a game board organizer disposed in the interior of the first storage side and being attached thereto, the game board organizer configured for separately holding game boards;

wherein the first and second storage sides constitute left and right halves of the game board chamber; and wherein the game board chamber further comprises a releasable fastener being actuatable for connecting the left and right halves of the game board chamber together and releasing the left and right halves of the game board chamber from one another.

29. The game board chamber of claim 28, wherein the fastener comprises a zipper running around the left and right halves of the game board chamber at the middle thereof.

30. The game board chamber of claim 28, further comprising a shoulder strap attachable on each of the left and right halves of the game board chamber.

31. The game board chamber of claim 28, further comprising two internal flaps, each of which is configured to become an exterior side wall of one of the halves of the game board chamber when the game board chamber is separated into the left and right halves.

* * * * *